US010927315B2

(12) United States Patent
Ramamurthy et al.

(10) Patent No.: US 10,927,315 B2
(45) Date of Patent: Feb. 23, 2021

(54) MAXIMIZING HIGH-VALUE CHEMICALS FROM MIXED PLASTIC USING DIFFERENT STEAM-CRACKER CONFIGURATIONS

(71) Applicant: SABIC Global Technologies B.V., Bergen op Zoom (NL)

(72) Inventors: Krishna Kumar Ramamurthy, Bangalore (IN); Nicolas Goyheneix, Elsloo (NL); Ravichander Narayanaswamy, Bangalore (IN); Lara Galan-Sanchez, Elsloo (NL)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 107 days.

(21) Appl. No.: 16/323,710

(22) PCT Filed: Oct. 4, 2017

(86) PCT No.: PCT/IB2017/056128
§ 371 (c)(1),
(2) Date: Feb. 6, 2019

(87) PCT Pub. No.: WO2018/069794
PCT Pub. Date: Apr. 19, 2018

(65) Prior Publication Data

US 2019/0177626 A1 Jun. 13, 2019

Related U.S. Application Data

(60) Provisional application No. 62/406,722, filed on Oct. 11, 2016.

(51) Int. Cl.

| | |
|---|---|
| ***C10G 69/06*** | (2006.01) |
| ***C07C 4/22*** | (2006.01) |
| ***C10G 1/00*** | (2006.01) |
| ***C10G 1/10*** | (2006.01) |
| ***C10G 9/36*** | (2006.01) |
| ***C10G 45/00*** | (2006.01) |
| ***C10G 51/06*** | (2006.01) |
| ***C10G 69/00*** | (2006.01) |

(52) U.S. Cl.
CPC ..... *C10G 69/06* (2013.01); *C10G 1/002* (2013.01); *C10G 1/10* (2013.01); *C10G 9/36* (2013.01); *C10G 45/00* (2013.01); *C10G 51/06* (2013.01); *C10G 69/00* (2013.01); *C10G 2400/20* (2013.01); *C10G 2400/30* (2013.01)

(58) Field of Classification Search
CPC ..... C10G 69/06; C10G 2300/4081; C10G 2400/20; C10G 2400/24; C10G 2400/30; C07C 4/22
See application file for complete search history.

(56) References Cited

U.S. PATENT DOCUMENTS

| | | | | |
|---|---|---|---|---|
| 4,108,730 | A | 8/1978 | Chen et al. | 201/2.5 |
| 5,158,982 | A | 10/1992 | Stapp | 521/41 |
| 5,364,995 | A | 11/1994 | Kirkwood et al. | 585/241 |
| 5,414,169 | A | 5/1995 | Takahashi et al. | 585/241 |
| 5,481,052 | A | 1/1996 | Hardman et al. | 585/241 |
| 5,731,483 | A * | 3/1998 | Stabel | C10G 1/002 585/241 |
| 6,774,271 | B2 | 8/2004 | Jiang | 585/241 |
| 2014/0121426 | A1 | 5/2014 | Tandon | 585/241 |

FOREIGN PATENT DOCUMENTS

| | | | |
|---|---|---|---|
| CN | 101292013 | B | 10/2012 |
| DE | 4441699 | A1 | 5/1996 |
| DE | 19724144 | C1 | 6/1998 |
| EP | 0713906 | B1 | 5/1999 |
| GB | 2158089 | A | 11/1985 |
| WO | WO2007043738 | A1 | 4/2007 |
| WO | WO2015128033 | A1 | 9/2015 |
| WO | WO2016142809 | A1 | 9/2016 |

OTHER PUBLICATIONS

International Search Report and Written Opinion from PCT/IB2017/056128 dated Jan. 4, 2018, 13 pages.
Wang, Songhan. "Ethylene Process and Technology." China Petrochemical Press. Jun. 30, 2000. Page 293.

* cited by examiner

*Primary Examiner* — Randy Boyer
(74) *Attorney, Agent, or Firm* — Norton Rose Fulbright US LLP

(57) ABSTRACT

A process for producing olefins and aromatics comprising converting plastics to a hydrocarbon product comprising a gas phase and a liquid phase in a pyrolysis unit; separating the hydrocarbon product into a hydrocarbon gas stream comprising the gas phase and a hydrocarbon liquid stream comprising the liquid phase; feeding the hydrocarbon gas stream to a gas steam cracker to produce a gas steam cracker product comprising olefins, wherein an olefins amount in the gas steam cracker product is greater than in the hydrocarbon gas stream; separating the hydrocarbon liquid stream into a first fraction (b.p.<300° C.) and a second fraction (b.p>300° C.); feeding the first fraction to a liquid steam cracker to produce a liquid steam cracker product comprising olefins and aromatics, wherein an olefins amount in the liquid steam cracker product is greater than in the first fraction; and recycling the second fraction to the pyrolysis unit.

20 Claims, 4 Drawing Sheets

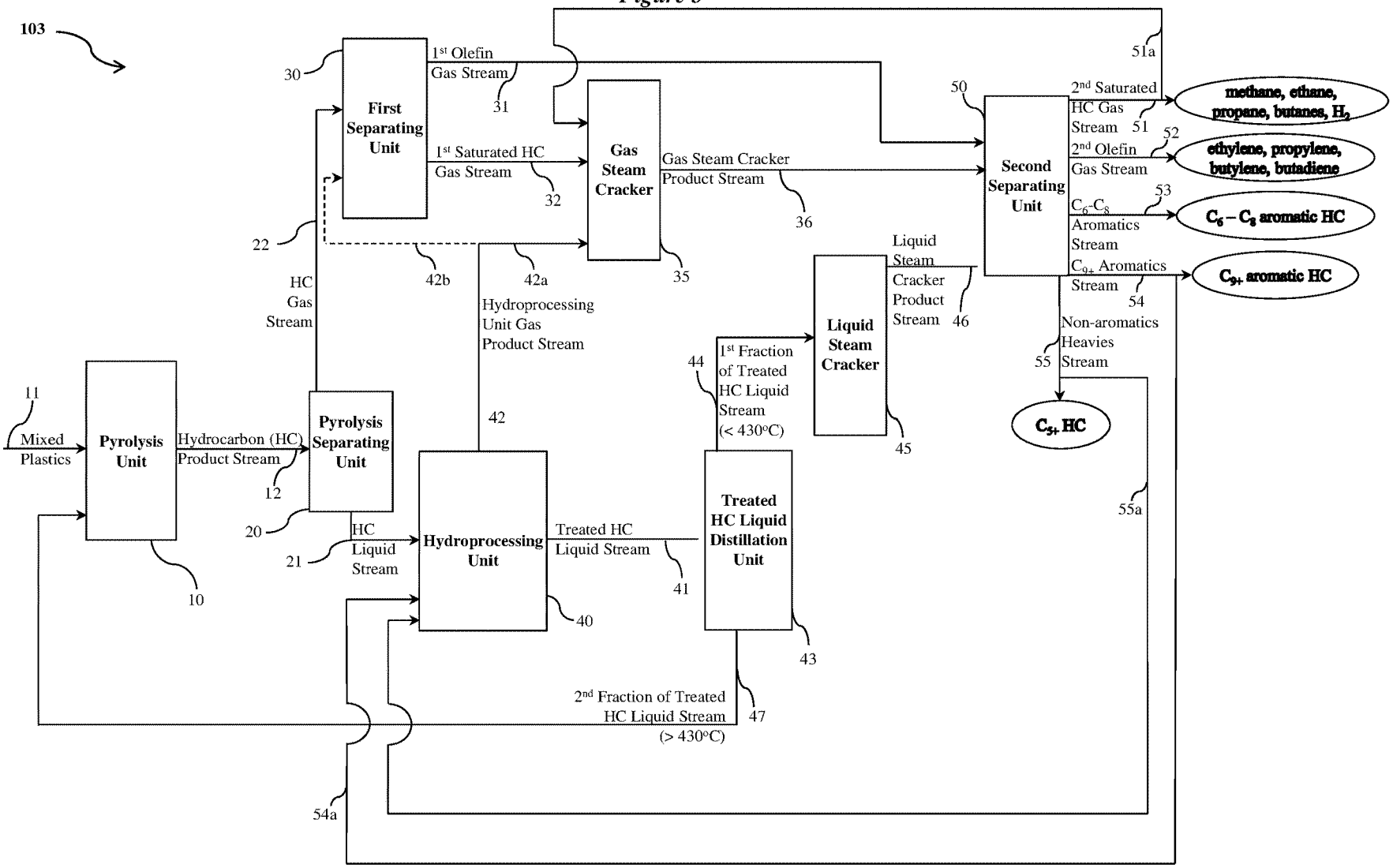
Figure 3
methane, ethane, propane, butanes, $H_2$
ethylene, propylene, butylene, butadiene
$C_6-C_8$ aromatic HC
$C_{9+}$ aromatic HC
$C_{5+}$ HC
2nd Saturated HC Gas Stream
51
51a
2nd Olefin Gas Stream
52
$C_6-C_8$ Aromatics Stream
53
$C_{9+}$ Aromatics Stream
54
Non-aromatics Heavies Stream
55
55a
Second Separating Unit
50
Liquid Steam Cracker Product Stream
46
Liquid Steam Cracker
45
Gas Steam Cracker Product Stream
36
Gas Steam Cracker
35
1st Fraction of Treated HC Liquid Stream (< 430°C)
44
Treated HC Liquid Distillation Unit
43
2nd Fraction of Treated HC Liquid Stream (> 430°C)
47
Treated HC Liquid Stream
41
Hydroprocessing Unit
40
Hydroprocessing Unit Gas Product Stream
42
42a
42b
1st Olefin Gas Stream
31
1st Saturated HC Gas Stream
32
First Separating Unit
30
HC Gas Stream
22
Pyrolysis Separating Unit
20
HC Liquid Stream
21
54a
Hydrocarbon (HC) Product Stream
12
Pyrolysis Unit
10
Mixed Plastics
11
103

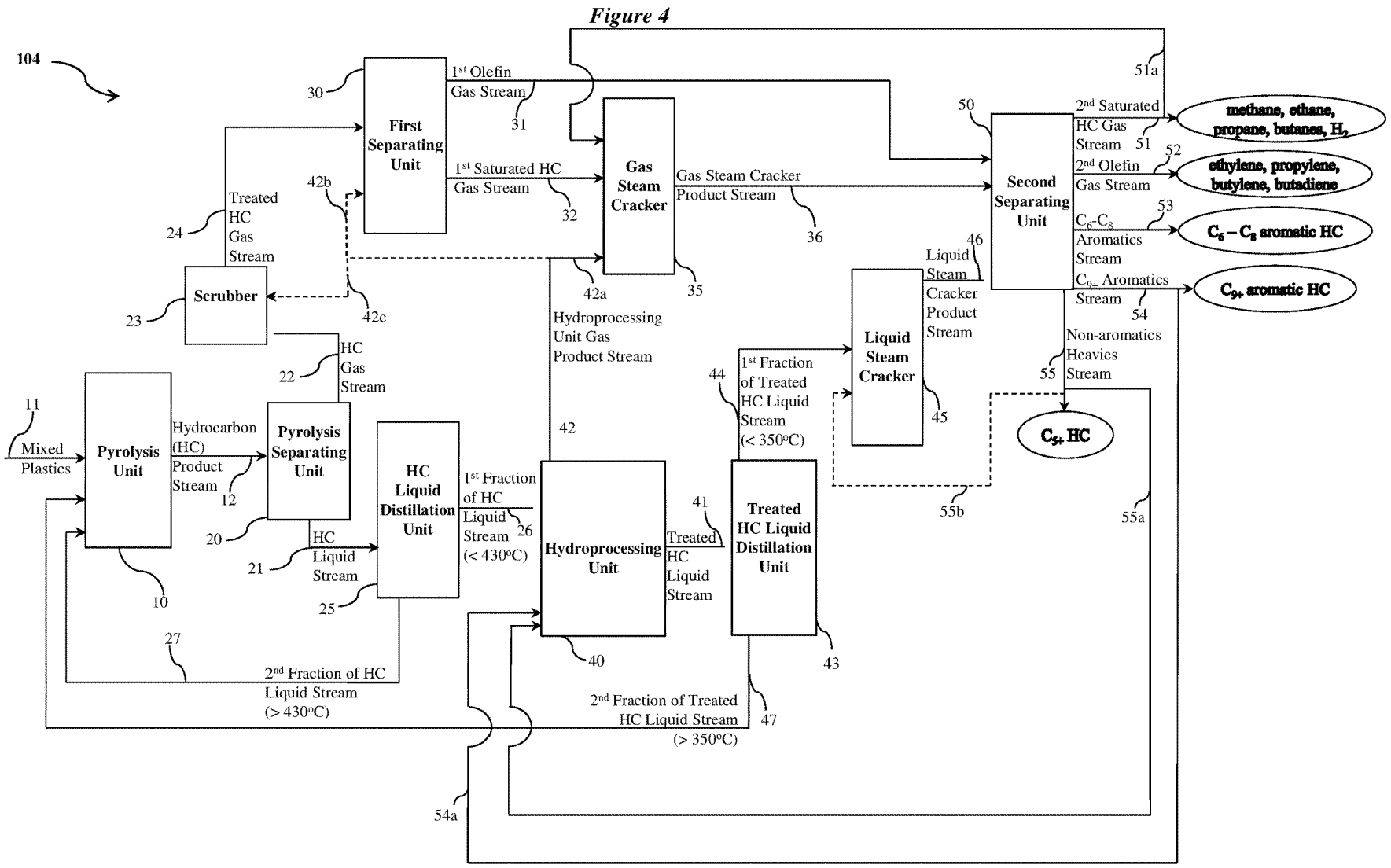
Figure 4
methane, ethane, propane, butanes, $H_2$
ethylene, propylene, butylene, butadiene
$C_6-C_8$ aromatic HC
$C_{9+}$ aromatic HC
$C_{5+}$ HC
Second Separating Unit
50
2nd Saturated HC Gas Stream
51
51a
2nd Olefin Gas Stream
52
$C_6-C_8$ Aromatics Stream
53
$C_{9+}$ Aromatics Stream
54
Non-aromatics Heavies Stream
55
55a
55b
Liquid Steam Cracker
45
Liquid Steam Cracker Product Stream
46
Gas Steam Cracker
35
Gas Steam Cracker Product Stream
36
First Separating Unit
30
1st Olefin Gas Stream
31
1st Saturated HC Gas Stream
32
Treated HC Gas Stream
24
Scrubber
23
42b
42c
Pyrolysis Unit
10
Mixed Plastics
11
104
Hydrocarbon (HC) Product Stream
12
Pyrolysis Separating Unit
20
HC Gas Stream
22
HC Liquid Stream
21
HC Liquid Distillation Unit
25
1st Fraction of HC Liquid Stream (< 430°C)
26
2nd Fraction of HC Liquid Stream (> 430°C)
27
Hydroprocessing Unit
40
Hydroprocessing Unit Gas Product Stream
42
42a
Treated HC Liquid Stream
41
Treated HC Liquid Distillation Unit
43
1st Fraction of Treated HC Liquid Stream (< 350°C)
44
2nd Fraction of Treated HC Liquid Stream (> 350°C)
47
54a

MAXIMIZING HIGH-VALUE CHEMICALS FROM MIXED PLASTIC USING DIFFERENT STEAM-CRACKER CONFIGURATIONS

This application is a national phase application under 35 U.S.C. § 371 of International Application No. PCT/IB2017/056128 filed Oct. 4, 2017, which claims priority to U.S. Provisional Patent Application No. 62/406,722 filed Oct. 11, 2016. The entire contents of each of the above-referenced disclosures is specifically incorporated by reference herein without disclaimer.

TECHNICAL FIELD

This disclosure relates to the production of high-value chemicals, such as olefins and aromatic hydrocarbons, from mixed plastics via processes which include pyrolysis, and gas steam cracking and liquid steam cracking.

BACKGROUND

Waste plastics may be converted to high-value chemicals (e.g., olefins, aromatic hydrocarbons, etc.) via pyrolysis. However, plastics pyrolysis can yield product streams having a wide boiling range. For example, conventionally (under common pyrolysis process conditions), some pyrolysis product streams are in liquid phase, while others are in gas phase. The liquid phase pyrolysis product streams are generally further cracked to increase the yield of high-value chemicals, while the gas phase high-value chemicals are conveyed to separating units for recovery of high-value chemicals. Such conventional processes produce high-value chemicals along with a wide variety of by-products (e.g., saturated hydrocarbons, heavy aromatic hydrocarbons, etc.). Thus, there is an ongoing need to develop methods for producing high-value chemicals derived from waste plastics while minimizing by-products.

BRIEF SUMMARY

Disclosed herein is a process for producing olefins and aromatic hydrocarbons from mixed plastics comprising (a) converting mixed plastics to a hydrocarbon product in a pyrolysis unit, wherein the hydrocarbon product comprises a gas phase and a liquid phase, (b) separating at least a portion of the hydrocarbon product into a hydrocarbon gas stream and a hydrocarbon liquid stream, wherein the hydrocarbon gas stream comprises at least a portion of the gas phase of the hydrocarbon product, and wherein the hydrocarbon liquid stream comprises at least a portion of the liquid phase of the hydrocarbon product, (c) feeding at least a portion of the hydrocarbon gas stream to a gas steam cracker to produce a gas steam cracker product stream, wherein the gas steam cracker product stream comprises olefins, and wherein an amount of olefins in the gas steam cracker product stream is greater than an amount of olefins in the hydrocarbon gas stream, (d) separating at least a portion of the hydrocarbon liquid stream into a first fraction of the hydrocarbon liquid stream and a second fraction of the hydrocarbon liquid stream, wherein the first fraction of the hydrocarbon liquid stream is characterized by a boiling point of less than about 300° C., and wherein the second fraction of the hydrocarbon liquid stream is characterized by a boiling point of equal to or greater than about 300° C., (e) feeding at least a portion of the first fraction of the hydrocarbon liquid stream to a liquid steam cracker to produce a liquid steam cracker product stream, wherein the liquid steam cracker product stream comprises olefins and aromatic hydrocarbons, and wherein an amount of olefins in the liquid steam cracker product stream is greater than an amount of olefins in the first fraction of the hydrocarbon liquid stream, and (f) recycling at least a portion of the second fraction of the hydrocarbon liquid stream to the pyrolysis unit.

Further disclosed herein is a process for producing olefins and aromatic hydrocarbons from mixed plastics comprising (a) converting mixed plastics to a hydrocarbon product in a pyrolysis unit, wherein the hydrocarbon product comprises a gas phase and a liquid phase, (b) separating the hydrocarbon product into a hydrocarbon gas stream and a hydrocarbon liquid stream, wherein the hydrocarbon gas stream comprises at least a portion of the gas phase of the hydrocarbon product, and wherein the hydrocarbon liquid stream comprises at least a portion of the liquid phase of the hydrocarbon product, (c) feeding at least a portion of the hydrocarbon gas stream to a gas steam cracker to produce a gas steam cracker product stream, wherein the gas steam cracker product stream comprises olefins, and wherein an amount of olefins in the gas steam cracker product stream is greater than an amount of olefins in the hydrocarbon gas stream, (d) separating at least a portion of the hydrocarbon liquid stream into a first fraction of the hydrocarbon liquid stream and a second fraction of the hydrocarbon liquid stream, wherein the first fraction of the hydrocarbon liquid stream is characterized by a boiling point of less than about 300° C., and wherein the second fraction of the hydrocarbon liquid stream is characterized by a boiling point of equal to or greater than about 300° C., (e) conveying at least a portion of the first fraction of the hydrocarbon liquid stream and hydrogen to a hydroprocessing unit to produce a treated hydrocarbon liquid stream and a hydroprocessing unit gas product stream, wherein the treated hydrocarbon liquid stream is characterized by a boiling point of less than about 300° C., wherein the treated hydrocarbon liquid stream is characterized by a chloride amount of less than about 10 ppmw chloride, based on the total weight of the treated hydrocarbon liquid stream, and wherein the treated hydrocarbon liquid stream is characterized by an olefin content of less than about 1 wt. % olefins, based on the total weight of the treated hydrocarbon liquid stream, (f) feeding at least a portion of the treated hydrocarbon liquid stream to a liquid steam cracker to produce a liquid steam cracker product stream, wherein the liquid steam cracker product stream comprises olefins and aromatic hydrocarbons, and wherein an amount of olefins in the liquid steam cracker product stream is greater than an amount of olefins in the hydrocarbon liquid stream, and (g) recycling at least a portion of the second fraction of the hydrocarbon liquid stream to the pyrolysis unit.

Also disclosed herein is a process for producing olefins and aromatic hydrocarbons from mixed plastics comprising (a) converting mixed plastics to a hydrocarbon product in a pyrolysis unit, wherein the hydrocarbon product comprises a gas phase and a liquid phase, (b) separating the hydrocarbon product into a hydrocarbon gas stream and a hydrocarbon liquid stream, wherein the hydrocarbon gas stream comprises at least a portion of the gas phase of the hydrocarbon product, wherein the hydrocarbon gas stream comprises olefins and saturated hydrocarbons, and wherein the hydrocarbon liquid stream comprises at least a portion of the liquid phase of the hydrocarbon product, (c) introducing at least a portion of the hydrocarbon gas stream to a first separating unit to produce a first saturated hydrocarbons gas stream and a first olefin gas stream, wherein the first olefin gas stream comprises at least a portion of the olefins of the hydrocarbon gas stream, wherein the first saturated hydrocarbons gas stream comprises at least a portion of the saturated hydrocarbons of the hydrocarbon gas stream, and wherein the first saturated hydrocarbons gas stream is characterized by an olefin content of less than about 1 wt. % olefins, based on the total weight of the first saturated hydrocarbons gas stream, (d) feeding at least a portion of the first saturated hydrocarbons gas stream to a gas steam cracker to produce a gas steam cracker product stream, wherein an amount of olefins in the gas steam cracker product stream is greater than an amount of olefins in the first saturated hydrocarbon gas stream, (e) conveying at least a portion of the hydrocarbon liquid stream and hydrogen to a hydroprocessing unit to produce a treated hydrocarbon liquid stream and a hydroprocessing unit gas product stream, wherein the treated hydrocarbon liquid stream is characterized by a chloride amount of less than about 10 ppmw chloride, based on the total weight of the treated hydrocarbon liquid stream, and wherein the treated hydrocarbon liquid stream is characterized by an olefin content of less than about 1 wt. % olefins, based on the total weight of the treated hydrocarbon liquid stream, (f) separating at least a portion of the treated hydrocarbon liquid stream into a first fraction of the treated hydrocarbon liquid stream and a second fraction of the treated hydrocarbon liquid stream, wherein the first fraction of the treated hydrocarbon liquid stream is characterized by a boiling point of less than about 430° C., and wherein the second fraction of the treated hydrocarbon liquid stream is characterized by a boiling point of equal to or greater than about 430° C., (g) feeding at least a portion of the first fraction of the treated hydrocarbon liquid stream to a liquid steam cracker to produce a liquid steam cracker product stream, wherein an amount of olefins in the liquid steam cracker product stream is greater than an amount of olefins in the first fraction of the treated hydrocarbon liquid stream, (h) feeding at least a portion of the hydroprocessing unit gas product stream to the first separating unit and/or the gas steam cracker, (i) introducing at least a portion of the gas steam cracker product stream, at least a portion of the liquid steam cracker product stream, at least a portion of the first olefin gas stream, or combinations thereof to a second separating unit to produce a second olefin gas stream, a second saturated hydrocarbons gas stream, a $C_6$-$C_8$ aromatics stream, a $C_{9+}$ aromatics stream, and a non-aromatic heavies stream; wherein the second olefin gas stream comprises ethylene, propylene, butylene, butadiene, or combinations thereof; wherein the second saturated hydrocarbons gas stream comprises methane, ethane, propane, butanes, hydrogen, or combinations thereof; wherein the $C_6$-$C_8$ aromatics stream comprises $C_6$-$C_8$ aromatic hydrocarbons, benzene, toluene, xylenes, ethylbenzene, or combinations thereof; wherein the $C_{9+}$ aromatics stream comprises $C_{9+}$ aromatic hydrocarbons; and wherein the non-aromatic heavies stream comprises $C_{5+}$ hydrocarbons other than $C_{6+}$ aromatic hydrocarbons, (j) recycling at least a portion of the second saturated hydrocarbons gas stream to the gas steam cracker, (k) recycling at least a portion of the non-aromatic heavies stream and at least a portion of the $C_{9+}$ aromatics stream to the hydroprocessing unit, and (l) recycling at least a portion of the second fraction of the treated hydrocarbon liquid stream to the pyrolysis unit.

BRIEF DESCRIPTION OF THE DRAWINGS

FIG. 3 displays yet another schematic of an olefins and aromatic hydrocarbons production system; and FIG. 4 displays still yet another schematic of an olefins and aromatic hydrocarbons production system.

DETAILED DESCRIPTION

Figure 1:
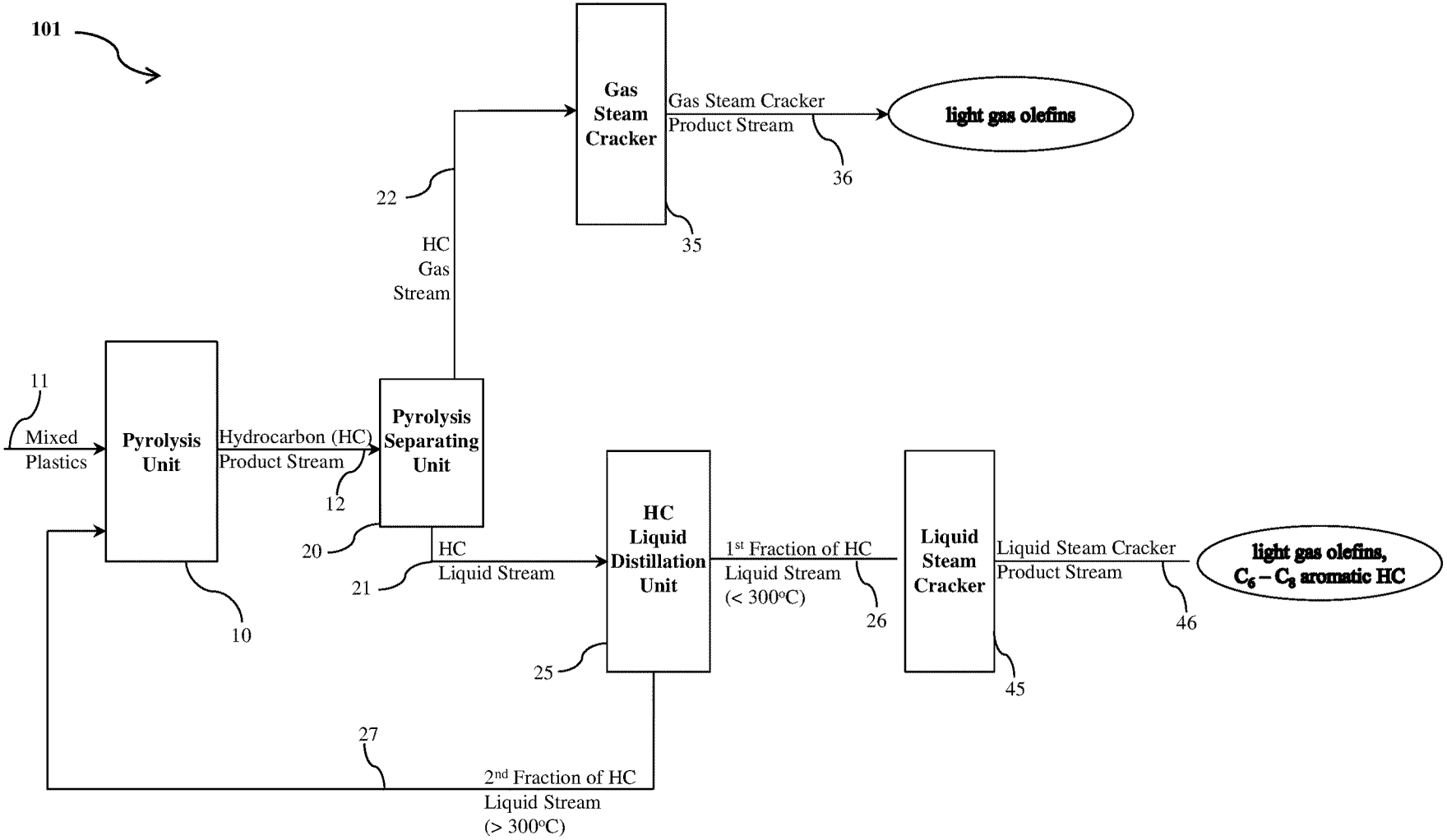
FIG. 1 displays a schematic of an olefins and aromatic hydrocarbons production system.

Disclosed herein are processes and systems for producing olefins and aromatic hydrocarbons from mixed plastics, which include conveying a liquid portion of a plastic pyrolysis product (e.g., hydrocarbon liquid stream) to a cracking furnace able to crack a liquid feedstock (e.g., liquid steam cracker), and conveying a gaseous portion of a plastic pyrolysis product (e.g., hydrocarbon gas stream) to a cracking furnace able to crack a gaseous feedstock (e.g., gas steam cracker). The processes may include producing a treated hydrocarbon liquid stream from the hydrocarbon liquid stream, wherein the treated hydrocarbon liquid stream may have a reduced boiling point when compared to a boiling point of the hydrocarbon liquid stream; and feeding the treated hydrocarbon liquid stream to a steam cracker. The processes may further include recovering high-value chemicals such as olefins and aromatic hydrocarbons from cracking furnace products.

Other than in the operating examples or where otherwise indicated, all numbers or expressions referring to quantities of ingredients, reaction conditions, and the like, used in the specification and claims are to be understood as modified in all instances by the term "about." Various numerical ranges are disclosed herein. Because these ranges are continuous, they include every value between the minimum and maximum values. The endpoints of all ranges reciting the same characteristic or component are independently combinable and inclusive of the recited endpoint. Unless expressly indicated otherwise, the various numerical ranges specified in this application are approximations. The endpoints of all ranges directed to the same component or property are inclusive of the endpoint and independently combinable. The term "from more than 0 to an amount" means that the named component is present in some amount more than 0, and up to and including the higher named amount.

The terms "a," "an," and "the" do not denote a limitation of quantity, but rather denote the presence of at least one of the referenced item. As used herein the singular forms "a," "an," and "the" include plural referents.

As used herein, "combinations thereof" is inclusive of one or more of the recited elements, optionally together with a like element not recited, e.g., inclusive of a combination of one or more of the named components, optionally with one or more other components not specifically named that have essentially the same function. As used herein, the term "combination" is inclusive of blends, mixtures, alloys, reaction products, and the like.

Reference throughout the specification to "an aspect," "another aspect," "other aspects," "some aspects," and so forth, means that a particular element (e.g., feature, structure, property, and/or characteristic) described in connection with the aspect is included in at least an aspect described herein, and may or may not be present in other aspects. In addition, it is to be understood that the described element(s) can be combined in any suitable manner in the various aspects.

As used herein, the terms "inhibiting" or "reducing" or "preventing" or "avoiding" or any variation of these terms, include any measurable decrease or complete inhibition to achieve a desired result.

As used herein, the term "effective," means adequate to accomplish a desired, expected, or intended result.

As used herein, the terms "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains") are inclusive or open-ended and do not exclude additional, unrecited elements or method steps.

Unless defined otherwise, technical and scientific terms used herein have the same meaning as is commonly understood by one of skill in the art.

Compounds are described herein using standard nomenclature. For example, any position not substituted by any indicated group is understood to have its valency filled by a bond as indicated, or a hydrogen atom. A dash ("-") that is not between two letters or symbols is used to indicate a point of attachment for a substituent. For example, —CHO is attached through the carbon of the carbonyl group.

Referring to FIG. 1, an olefins and aromatic hydrocarbons production system 101 is disclosed. The olefins and aromatic hydrocarbons production system 101 generally comprises a pyrolysis unit 10; a pyrolysis separating unit 20; a hydrocarbon liquid distillation unit 25; a gas steam cracker 35; and a liquid steam cracker 45.

Figure 2:
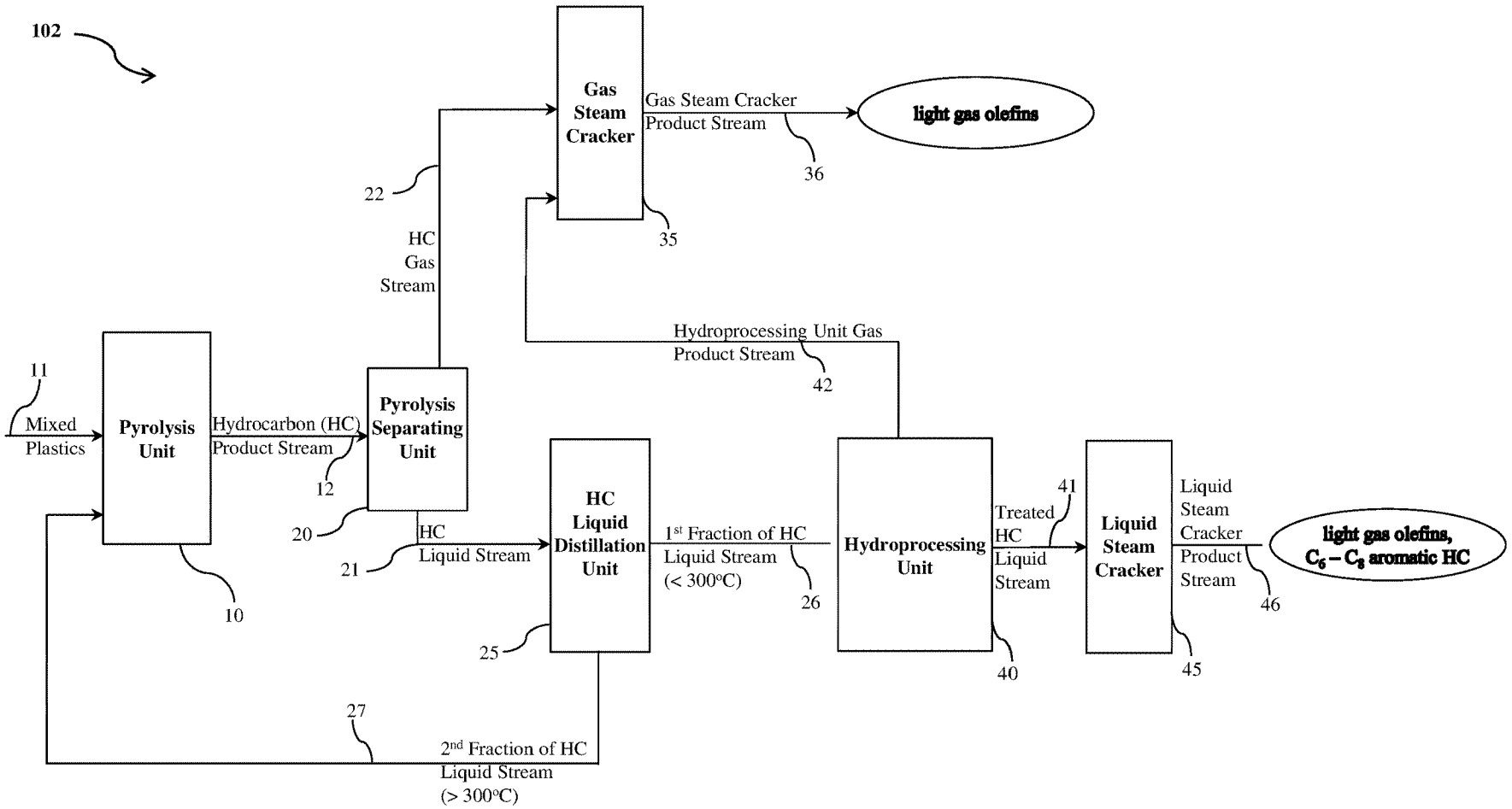
FIG. 2 displays another schematic of an olefins and aromatic hydrocarbons production system.

Referring to FIG. 2, an olefins and aromatic hydrocarbons production system 102 is disclosed.

The olefins and aromatic hydrocarbons production system 102 generally comprises a pyrolysis unit 10; a pyrolysis separating unit 20; a hydrocarbon liquid distillation unit 25; a gas steam cracker 35; a hydroprocessing unit 40; and a liquid steam cracker 45.

Referring to FIG. 3, an olefins and aromatic hydrocarbons production system 103 is disclosed. The olefins and aromatic hydrocarbons production system 103 generally comprises a pyrolysis unit 10; a pyrolysis separating unit 20; a first separating unit 30; a gas steam cracker 35; a hydroprocessing unit 40; a treated hydrocarbon liquid distillation unit 43; a liquid steam cracker 45; and a second separating unit 50.

Referring to FIG. 4, an olefins and aromatic hydrocarbons production system 104 is disclosed. The olefins and aromatic hydrocarbons production system 104 generally comprises a pyrolysis unit 10; a pyrolysis separating unit 20; a scrubber 23; a hydrocarbon liquid distillation unit 25; a first separating unit 30; a gas steam cracker 35; a hydroprocessing unit 40; a treated hydrocarbon liquid distillation unit 43; a liquid steam cracker 45; and a second separating unit 50. As will be appreciated by one of skill in the art, and with the help of this disclosure, olefins and aromatic hydrocarbons production system components shown in FIGS. 1-4 can be in fluid communication with each other (as represented by the connecting lines indicating a direction of fluid flow) through any suitable conduits (e.g., pipes, streams, etc.). Common reference numerals refer to common components present in one or more of the Figures, and the description of a particular component is generally applicable across respective Figures wherein the component is present, except as otherwise indicated herein.

A process for producing olefins and aromatic hydrocarbons from mixed plastics (e.g., virgin plastics, waste plastics, etc.) can comprise a step of converting mixed plastics to a hydrocarbon product stream in a pyrolysis unit. The process can comprise introducing the mixed plastics to a pyrolysis unit to produce a pyrolysis product (e.g., hydrocarbon (HC) product), wherein the pyrolysis product comprises a gas phase and a liquid phase.

Mixed plastics can be either placed in the pyrolysis unit 10 or fed to the pyrolysis unit 10 via mixed plastics stream 11. In the pyrolysis unit 10, the mixed plastics stream 11 is converted via pyrolysis to a hydrocarbon product stream 12, wherein the hydrocarbon product stream 12 comprises a gas phase (e.g., pyrolysis gases, such as $C_1$ to $C_4$ gases, carbon monoxide (CO), carbon dioxide ($CO_2$), hydrochloric acid (HCl) gas, etc.) and a liquid phase (e.g., pyrolysis liquid).

Mixed plastics which are loaded into or fed to the pyrolysis unit 10 via mixed plastics stream 11 may include post-consumer waste plastics, such as mixed plastic waste. Mixed plastics can comprise chlorinated plastics (e.g., chlorinated polyethylene), polyvinylchloride (PVC), polyvinylidene chloride (PVDC), non-chlorinated plastics (e.g., polyolefins, polyethylene, polypropylene, polyethylene terephthalate (PET), polybutylene terephthalate, polystyrene, copolymers, etc.), and the like, or mixtures thereof. In some aspects, the mixed plastics can comprise PVC, PVDC, polyethylene terephthalate, polybutylene terephthalate, polyolefins, polystyrenes, and the like, or combinations thereof. Generally, waste plastics comprise long chain molecules or polymer hydrocarbons. Waste plastics as disclosed herein also include used tires. The mixed plastics can comprise virgin mixed plastics and/or waste mixed plastics.

The mixed plastics stream 11 can comprise chloride in an amount of equal to or greater than about 10 parts per million weight (ppmw), 50 ppmw, 100 ppmw, 200 ppmw, 300 ppmw, 400 ppmw, 500 ppmw, 600 ppmw, 700 ppmw, 800 ppmw, 900 ppmw, 600 ppmw, or 1,000 ppmw chloride, based on the total weight of the mixed plastics. The mixed plastics stream 11 can comprise PVC and/or PVDC in an amount of equal to or greater than about 400 ppmw, alternatively equal to or greater than about 700 ppmw, or alternatively equal to or greater than about 1,000 ppmw, based on the total weight of the mixed plastics.

The pyrolysis unit 10 may be any suitable vessel configured to convert waste plastics into gas phase and liquid phase products (e.g., simultaneously). The vessel may be configured for gas phase, liquid phase, vapor-liquid phase, or slurry phase operation. The vessel may contain one or more beds of inert material or pyrolysis catalyst comprising sand, zeolite, alumina, a catalytic cracking catalyst, or combinations thereof. Generally, the pyrolysis catalyst is capable of transferring heat to the components subjected to the pyrolysis process in the pyrolysis unit 10. The pyrolysis unit 10 may be operated adiabatically, isothermally, non-adiabatically, non-isothermally, or combinations thereof. The pyrolysis reactions of this disclosure may be carried out in a single stage or in multiple stages. For example, the pyrolysis unit 10 can be two reactor vessels fluidly connected in series.

In a configuration where the pyrolysis unit 10 comprises two vessels, the pyrolysis process may be divided into a first stage which is performed in a first vessel and in a second stage fluidly connected downstream of the first stage which is performed in the second vessel. As will be appreciated by one of skill in the art, and with the help of this disclosure, the second stage may enhance the pyrolysis of an intermediate pyrolysis product stream flowing from the first stage into the second stage, to yield a hydrocarbon product stream 12 flowing from the second stage. In some configurations, the first stage may utilize thermal cracking of the waste plastics, and the second stage may utilize catalytic cracking of the waste plastics to yield the hydrocarbon product stream 12 flowing from the second stage. Alternatively, the first stage may utilize catalytic cracking of the waste plastics, and the second stage may utilize thermal cracking of the waste plastics to yield the hydrocarbon product stream 12 flowing from the second stage.

In some configurations, the pyrolysis unit 10 may include one or more equipment configured to convert mixed plastics into gas phase and liquid phase products. The one or more equipment may or may not contain an inert material or pyrolysis catalyst as described above. Examples of such equipment include one or more of heated extruders, heated rotating kiln, heated tank-type reactors, packed bed reactors, bubbling fluidized bed reactors, circulating fluidized bed reactors, empty heated vessels, enclosed heated surfaces where plastic flows down along the wall and cracks, vessels surrounded by ovens or furnaces, or any other suitable equipment offering a heated surface to assist in cracking.

The pyrolysis unit 10 can be configured to pyrolyse (e.g., crack), and in some aspects (e.g., where hydrogen is added to the pyrolysis unit 10), additionally hydrogenate components of the mixed plastics stream 11 fed to the pyrolysis unit 10. Examples of reactions which may occur in the pyrolysis unit 10 include, but are not limited to conversion of one or more aromatics to one or more cycloparaffins, isomerization of one or more normal paraffins to one or more i-paraffins, selective ring opening of one or more cycloparaffins to one or more i-paraffins, cracking of long chain length molecules to short chain length molecules, removal of heteroatoms from heteroatom-containing hydrocarbons (e.g., dechlorination), or combinations thereof.

In one or more configurations of the pyrolysis unit 10, a head space purge gas is utilized in all or a portion of the pyrolysis stage(s) (conversion of waste plastics to a liquid phase and/or gas phase products) to enhance cracking of plastics, produce valuable products, provide a feed for steam cracking, or combinations thereof. The head space purge gas may include hydrogen ($H_2$), $C_1$ to $C_4$ hydrocarbon gases (e.g., alkanes, methane, ethane, propane, butane, isobutane), inert gases (e.g., nitrogen ($N_2$), argon, helium, steam), and the like, or combinations thereof. The use of a head space purge gas assists in the dechlorination in the pyrolysis unit 10. The head space purge gas may be introduced to the pyrolysis unit 10 to aid in the removal of volatiles entrained in the melted mixed plastics present in the pyrolysis unit 10.

A hydrogen ($H_2$) containing stream can be added to the pyrolysis unit 10 to enrich the pyrolysis unit environment with $H_2$, assist in stripping entrapped hydrogen chloride in the pyrolysis unit, provide a local environment rich in hydrogen in a pyrolysis melt or liquid, or combinations thereof; for example via a $H_2$ containing stream fed directly to the pyrolysis unit independently of the mixed plastics stream 11. In some aspects, $H_2$ can also be introduced along with stream 11 to the pyrolysis unit 10, with adequate safety measures incorporated for hydrogen handling with plastics feed.

The pyrolysis unit 10 may facilitate any reaction of the components of the mixed plastics stream 11 in the presence of, or with, hydrogen. Reactions may occur such as the addition of hydrogen atoms to double bonds of unsaturated molecules (e.g., olefins, aromatic compounds), resulting in saturated molecules (e.g., paraffins, i-paraffins, naphthenes). Additionally or alternatively, reactions in the pyrolysis unit 10 may cause a rupture of a bond of an organic compound, with a subsequent reaction and/or replacement of a heteroatom with hydrogen.

The use of hydrogen in the pyrolysis unit 10 can have beneficial effects of i) reducing the coke as a result of cracking, ii) keeping the catalyst used (if any) in the process in an active condition, iii) improving removal of chloride from stream 11 such that the hydrocarbon product stream 12 from pyrolysis unit 10 is substantially dechlorinated with respect to mixed plastics stream 11, which minimizes the chloride removal requirement in units downstream of the pyrolysis unit 10, iv) hydrogenating of olefins, v) reducing diolefins in hydrocarbon product stream 12, vi) helping operate the pyrolysis unit 10 at reduced temperatures for same levels of conversion of mixed plastics stream 11 in the pyrolysis unit 10, or combinations of i)-vi).

The pyrolysis processes in the pyrolysis unit 10 may be low severity or high severity. Low severity pyrolysis processes may occur at a temperature of 250° C. to 450° C., alternatively 275° C. to 425° C., or alternatively 300° C. to 400° C., may produce pyrolysis oils rich in mono- and di-olefins as well as a significant amount of aromatics, and may include chloride compounds. High severity pyrolysis processes may occur at a temperature of 450° C. to 750° C., alternatively 500° C. to 700° C., or alternatively 550° C. to 650° C., may produce pyrolysis oils rich in aromatics, and may include chloride compounds.

A hydrocarbon product stream 12 can be recovered as an effluent from the pyrolysis unit 10 and conveyed (e.g., flowed) to the pyrolysis separating unit 20.

A process for producing olefins and aromatic hydrocarbons from mixed plastics can comprise separating at least a portion of the hydrocarbon product stream 12 in the pyrolysis separating unit 20 into a hydrocarbon gas stream 22 and a hydrocarbon liquid stream 21, wherein the hydrocarbon gas stream 22 comprises at least a portion of the gas phase of the hydrocarbon product stream 12, and wherein the hydrocarbon liquid stream 21 comprises at least a portion of the liquid phase of the hydrocarbon product stream 12. The pyrolysis separating unit 20 may comprise any suitable gas-liquid separator, such as a vapor-liquid separator, oil-gas separators, gas-liquid separators, degassers, deliqulizers, scrubbers, traps, flash drums, compressor suction drums, gravity separators, centrifugal separators, filter vane separators, mist eliminator pads, liquid-gas coalescers, and the like, or combinations thereof.

In some configurations, the pyrolysis separating unit 20 can be a condenser which operates at conditions which condense a portion of the hydrocarbon product stream 12 into hydrocarbon liquids (e.g., liquid product) while leaving the hydrocarbon gases in the gas phase (e.g., gas product). A liquid product flows from the pyrolysis separating unit 20 in hydrocarbon liquid stream 21, and a gas product flows from the pyrolysis separating unit 20 in hydrocarbon gas stream 22.

The hydrocarbon gas stream 22 can comprise $C_1$ to $C_4$ hydrocarbons (e.g., saturated hydrocarbons, light gas olefins), hydrogen ($H_2$), inert gases (e.g., nitrogen ($N_2$), argon, helium, steam), carbon monoxide (CO), carbon dioxide ($CO_2$), HCl, and the like, or combinations thereof. The hydrocarbon gas stream 22 can comprise at least a portion of the chloride of the mixed plastics stream 11. In some aspects, hydrocarbon gas stream 22 can comprise equal to or greater than about 90 wt. %, 93 wt. %, 95 wt. %, or 99 wt. % of the total chloride the mixed plastics stream 11, based on the total weight of the chloride in the mixed plastics stream 11.

The hydrocarbon gas stream 22 can be further introduced to the gas steam cracker 35 (e.g., FIGS. 1 and 2), to the first separating unit 30 (e.g., FIG. 3), or to the scrubber 23 (e.g., FIG. 4), as will be described in more detail later herein.

The hydrocarbon liquid stream 21 can comprise paraffins, i-paraffins, olefins, naphthenes, aromatic compounds, organic chlorides, or combinations thereof. When the hydrocarbon liquid stream 21 comprises paraffins, i-paraffins, olefins, naphthenes, and aromatic compounds, the stream can be referred to as a PIONA stream; and when the hydrocarbon liquid stream 21 comprises paraffins, olefins, naphthenes, and aromatic compounds, the stream can be referred to as a PONA stream.

The hydrocarbon liquid stream 21 can comprise one or more chloride compounds (e.g., organic chlorides, such as aliphatic chlorine-containing hydrocarbons, aromatic chlorine-containing hydrocarbons, and other chlorine-containing hydrocarbons) in an amount of less than the chloride amount in the mixed plastics stream 11. The amount of chloride compounds in the hydrocarbon liquid stream 21 may be less than 100 ppmw, 50 ppmw, 25 ppmw, or 10 ppmw chloride (e.g., equivalent chlorides), based on the total weight of the hydrocarbon liquid stream 21. A decrease in one or more chloride compounds from the mixed plastics to the hydrocarbon liquid stream is due to dechlorination of the mixed plastics in the pyrolysis unit 10.

Examples of paraffins which may be present in the hydrocarbon liquid stream 21 include, but are not limited to, $C_1$ to $C_{22}$ n-paraffins and i-paraffins. The paraffins can be present in the hydrocarbon liquid stream 21 in an amount of less than 10 wt. % based on the total weight of the hydrocarbon liquid stream 21. Alternatively, the paraffins can be present in the hydrocarbon liquid stream 21 in an amount of 10 wt. %, 20 wt. %, 30 wt. %, 40 wt. %, 50 wt. %, 60 wt. %, or more based on the total weight of the hydrocarbon liquid stream 21. While certain hydrocarbon liquid streams include paraffins of carbon numbers up to 22, the present disclosure is not limited to carbon number 22 as an upper end-point of the suitable range of paraffins, and the paraffins can include higher carbon numbers, e.g., 23, 24, 25, 26, 27, 28, 29, 30, 31, 32, 33, 34, 35, 36, 37, 38, 39, 40, and higher.

Examples of olefins which may be present in hydrocarbon liquid stream 21 include, but are not limited to, $C_2$ to $C_{10}$ olefins and combinations thereof. Where hydrogen is introduced to the pyrolysis unit 10, due to hydrogenation reactions in the pyrolysis unit 10, the olefins can be present in the hydrocarbon liquid stream 21 in an amount of less than 10 wt. %, based on the total weight of the hydrocarbon liquid stream 21. Alternatively, the olefins can be present in the hydrocarbon liquid stream 21 in an amount of 5 wt. %, 10 wt. %, 20 wt. %, 30 wt. %, 40 wt. %, or more based on the total weight of the hydrocarbon liquid stream 21. While certain hydrocarbon streams include olefins of carbon numbers up to 10, the present disclosure is not limited to carbon number 10 as an upper end-point of the suitable range of olefins, and the olefins can include higher carbon numbers, e.g., 11, 12, 13, 14, 15, 16, 17, 18, 19, 20, 21, 22, 23, 24, 25, 26, 27, 28, 29, 30, and higher.

In some aspects, the hydrocarbon liquid stream 21 comprises no olefins, e.g., the hydrocarbon liquid stream 21 is substantially free of olefins.

Examples of naphthenes which may be present in the hydrocarbon liquid stream 21 include, but are not limited to, cyclopentane, cyclohexane, cycloheptane, and cyclooctane. The naphthenes can be present in the hydrocarbon liquid stream 21 in an amount of less than 10 wt. %, based on the total weight of the hydrocarbon liquid stream 21. Alternatively, the naphthenes can be present in the hydrocarbon liquid stream 21 in an amount of 10 wt. %, 20 wt. %, 30 wt. %, 40 wt. %, or more based on the total weight of the hydrocarbon liquid stream 21. While certain hydrocarbon streams include naphthenes of carbon numbers up to 8, the present disclosure is not limited to carbon number 8 as an upper end-point of the suitable range of naphthenes, and the naphthenes can include higher carbon numbers, e.g., 9, 10, 11, 12, 13, 14, 15, 16, 17, 18, 19, 20, 21, 22, 23, 24, 25, 26, 27, 28, 29, 30, and higher.

The hydrocarbon liquid stream 21 may comprise aromatic hydrocarbons with carbon numbers of 6, 7, 8, 9, 10, 11, 12, 13, 14, 15, 16, 17, 18, 19, 20, 21, 22, 23, 24, 25, 26, 27, 28, 29, 30, and higher. In an aspect, the aromatic hydrocarbons carbon number can be as high as 22. Nonlimiting examples of aromatic hydrocarbons suitable for use in the present disclosure as part of the hydrocarbon liquid stream 21 include benzene, toluene, xylenes, ethylbenzene, propylbenzenes, trimethylbenzenes, tetramethylbenzenes, dimethylnaphthalene, biphenyl, and the like, or combinations thereof. The aromatic hydrocarbons can be present in the hydrocarbon liquid stream 21 in an amount of 5 wt. %, 10 wt. %, 15 wt. %, 20 wt. %, 25 wt. %, 30 wt. %, 35 wt. %, 40 wt. %, 50 wt. %, 60 wt. %, 70 wt. %, 80 wt. % or more based on the total weight of the hydrocarbon liquid stream 21.

In some aspects, equal to or greater than about 10 wt. %, alternatively 25 wt. %, or alternatively 50 wt. % of the hydrocarbon liquid stream 21 is characterized by a boiling point of less than about 370° C.

In other aspects, equal to or greater than about 90 wt. %, alternatively 95 wt. %, or alternatively 99 wt. % of the hydrocarbon liquid stream 21 is characterized by a boiling point of less than about 350° C.

In some aspects, and as illustrated in the configuration of olefins and aromatic hydrocarbons production systems 101 and 102 in FIGS. 1 and 2, respectively, a process for producing olefins and aromatic hydrocarbons from mixed plastics can comprise separating at least a portion of the hydrocarbon liquid stream 21 in the hydrocarbon liquid distillation unit 25 into a first fraction 26 of the hydrocarbon liquid stream and a second fraction 27 of the hydrocarbon liquid stream, wherein the first fraction 26 of the hydrocarbon liquid stream is characterized by a boiling point of less than about 300° C., and wherein the second fraction 27 of the hydrocarbon liquid stream is characterized by a boiling point of equal to or greater than about 300° C. The hydrocarbon liquid distillation unit 25 can comprise any suitable distillation column, such as a distillation column with trays or plates, a distillation column with packing material, or combinations thereof.

The first fraction 26 of the hydrocarbon liquid stream may comprise any components of the hydrocarbon liquid stream 21 with a boiling point of less than about 300° C., such as paraffins, i-paraffins, olefins, naphthenes, and aromatic compounds with a boiling point of less than about 300° C. The second fraction 27 of the hydrocarbon liquid stream may comprise any components of the hydrocarbon liquid stream 21 with a boiling point of equal to or greater than about 300° C., such as paraffins, i-paraffins, olefins, naphthenes, and aromatic compounds with a boiling point of equal to or greater than about 300° C. As will be appreciated by one of skill in the art, and with the help of this disclosure, some components of the hydrocarbon liquid stream 21 form azeotropes, and as such, some components with a boiling point of equal to or greater than about 300° C. can be found in the first fraction 26 of the hydrocarbon liquid stream, although the first fraction 26 of the hydrocarbon liquid stream is characterized by a boiling point of less than about 300° C. Further, as will be appreciated by one of skill in the art, and with the help of this disclosure, some components of the hydrocarbon liquid stream 21 form azeotropes, and as such, some components with a boiling point of less than about 300° C. can be found in the second fraction 27 of the hydrocarbon liquid stream, although the second fraction 27 of the hydrocarbon liquid stream is characterized by a boiling point of equal to or greater than about 300° C.

In other aspects, and as illustrated in the configuration of olefins and aromatic hydrocarbons production system 104 in FIG. 4, a process for producing olefins and aromatic hydrocarbons from mixed plastics can comprise separating at least a portion of the hydrocarbon liquid stream 21 in the hydrocarbon liquid distillation unit 25 into a first fraction 26 of the hydrocarbon liquid stream and a second fraction 27 of the hydrocarbon liquid stream, wherein the first fraction 26 of the hydrocarbon liquid stream is characterized by a boiling point of less than about 430° C., and wherein the second fraction 27 of the hydrocarbon liquid stream is characterized by a boiling point of equal to or greater than about 430° C. While the current disclosure will be discussed in detail in the context of the hydrocarbon liquid distillation unit 25 fractionating the hydrocarbon liquid stream 21 into two fractions around a cut off boiling point of from about 300° C. to about 430° C., it should be understood that any suitable boiling point can be used as the fractionation cut off boiling point. As will be appreciated by one of skill in the art, and with the help of this disclosure, the cut off boiling point for collecting the two fractions from the hydrocarbon liquid distillation unit 25 can be any suitable cut off boiling point that allows both for recycling sufficient heavy compounds to the pyrolysis unit, and for having a sufficient feed stream for the liquid steam cracker 45, wherein the liquid steam cracker feed stream meets the feed requirements of the cracker. Further, it should be understood that any suitable number of fractions can be collected from the hydrocarbon liquid distillation unit 25, such as 2, 3, 4, 5, 6, or more fractions.

In an aspect, the cut off boiling point for fractionating the hydrocarbon liquid stream 21 in the hydrocarbon liquid distillation unit 25 into the first fraction 26 and the second fraction 27 can be from about 250° C. to about 450° C., alternatively from about 300° C. to about 430° C., or alternatively from about 325° C. to about 400° C.

In an aspect, the second fraction 27 of the hydrocarbon liquid stream can be recycled to the pyrolysis unit 10. Without wishing to be limited by theory, the second fraction 27 contains higher boiling point compounds, which have higher molecular weight and/or longer chains, and by recycling these heavier compounds to the pyrolysis unit 10, more compounds having lower molecular weight and/or shorter chains, respectively, are produced, thereby increasing an yield (e.g., volume, amount) for the stream introduced to the liquid steam cracker 45 (e.g., first fraction 26, treated hydrocarbon liquid stream 41, first fraction 44 of treated hydrocarbon liquid stream, etc.), consequently increasing the yield of high-value chemicals produced by the liquid steam cracker 45 (e.g., olefins, aromatic hydrocarbons).

In some aspects, a process for producing olefins and aromatic hydrocarbons from mixed plastics can comprise conveying at least a portion of the hydrocarbon liquid stream 21 and hydrogen to the hydroprocessing unit 40 to produce a treated hydrocarbon liquid stream 41 and a hydroprocessing unit gas product stream 42. As illustrated in the configuration of olefins and aromatic hydrocarbons production system 103 in FIG. 3, at least a portion of the hydrocarbon liquid stream 21 can be introduced to the hydroprocessing unit 40.

In other aspects, and as illustrated in the configuration of olefins and aromatic hydrocarbons production systems 102 and 104 in FIGS. 2 and 4, respectively, only a portion (e.g., first fraction 26) of the hydrocarbon liquid stream 21 is introduced to the hydroprocessing unit 40 to produce a treated hydrocarbon liquid stream 41 and a hydroprocessing unit gas product stream 42. In such aspects, the portion of the hydrocarbon liquid stream 21 that is introduced to the hydroprocessing unit 40 can be recovered from stream 21 by distillation, as disclosed herein.

The hydroprocessing unit 40 can be any suitable hydroprocessing reactor, such as a hydrocracker, a fluid catalytic cracker, a fluid catalytic cracker operated in hydropyrolysis mode, a thermal cracking reactor, a thermal cracking reactor operated in hydropyrolysis mode, a hydrotreater, a hydrodealkylation unit, and the like, or combinations thereof. In some configurations, the hydroprocessing reactor can be a thermal pyrolysis reactor, a temperature controlled stirred tank batch reactor, a continuous rotary kiln, a twin screw extruder reactor, a circulating fluidized bed reactor similar to a fluid catalytic cracker, a bubbling fluidized bed reactor, and the like, or combinations thereof operated in a hydrogen environment. Fluid catalytic crackers and thermal crackers operated in hydropyrolysis mode are described in more detail in U.S. Provisional Application No. 62/025,762 filed 17 Jul. 2014 and International Application No. PCT/IB2015/055295 filed 13 Jul. 2015; each of which is incorporated by reference herein in its entirety. Generally, hydropyrolysis refers to a pyrolysis process conducted in the presence of hydrogen.

A hydrogen ($H_2$) containing stream can be added to the hydrocarbon liquid stream 21 and/or the first fraction 26 of the hydrocarbon liquid stream before entering the hydroprocessing unit 40. Additionally or alternatively, a $H_2$ containing stream can be added to the hydroprocessing unit 40 to enrich the hydroprocessing unit environment with $H_2$, for example via a $H_2$ containing stream fed directly to the hydroprocessing unit 40 independently of the hydrocarbon liquid stream 21 and/or the first fraction 26 of the hydrocarbon liquid stream.

The hydroprocessing unit 40 can be characterized by a temperature of from about 250° C. to about 730° C., alternatively from about 300° C. to about 700° C., or alternatively from about 350° C. to about 650° C.

In some aspects, a hydroprocessing unit product stream can be recovered from the hydroprocessing unit 40, wherein the hydroprocessing unit product stream can comprise a gas phase and a liquid phase. In such aspects, the hydroprocessing unit product stream can be separated into the treated hydrocarbon liquid stream 41 and the hydroprocessing unit gas product stream 42, wherein the treated hydrocarbon liquid stream 41 comprises at least a portion of the liquid phase of the hydroprocessing unit product stream; and wherein the hydroprocessing unit gas product stream 42 comprises at least a portion of the gas phase of the hydroprocessing unit product stream.

The hydroprocessing unit gas product stream 42 can comprise $C_1$ to $C_4$ hydrocarbons, $H_2$, inert gases (e.g., nitrogen ($N_2$), argon, helium, steam), HCl, and the like, or combinations thereof. The hydroprocessing unit gas product stream 42 can comprise at least a portion of the chloride of the hydrocarbon liquid stream 21 and/or at least a portion of the chloride of the first fraction 26 of the hydrocarbon liquid stream. At least a portion of the hydroprocessing unit gas product stream 42 can be further introduced to the scrubber 23, as will be described in more detail later herein.

The treated hydrocarbon liquid stream 41 can be characterized by a boiling point that is lower than the boiling point of the hydrocarbon liquid stream 21 and/or the boiling point of the first fraction 26 of the hydrocarbon liquid stream. A decrease in boiling point from the hydrocarbon liquid stream 21 and/or the first fraction 26 of the hydrocarbon liquid stream to the treated hydrocarbon liquid stream 41 is due to cracking of the hydrocarbon liquid stream 21 and/or the first fraction 26 of the hydrocarbon liquid stream, respectively in the hydroprocessing unit 40. In some aspects, the treated hydrocarbon liquid stream 41 can be characterized by a boiling point of less than about 300° C., less than about 275° C., or less than about 250° C. As will be appreciated by one of skill in the art, and with the help of this disclosure, when the boiling point of the feed to the hydroprocessing unit 40 is less than about 300° C. (e.g., a first fraction 26 of the hydrocarbon liquid stream having a boiling point of less than about 300° C.), the boiling point of the treated hydrocarbon liquid stream 41 can be substantially less than about 300° C. if the hydrotreating process occurring in the hydroprocessing unit 40 is a hydrocracking process.

The hydrocarbon liquid stream 21 and/or the first fraction 26 of the hydrocarbon liquid stream can comprise aromatic compounds. In some aspects, a portion of the aromatic compounds of the hydrocarbon liquid stream 21 and/or the first fraction 26 of the hydrocarbon liquid stream can undergo a ring opening reaction in the hydroprocessing unit 40 to produce non-aromatic compounds, wherein such non-aromatic compounds can be further introduced to the liquid steam cracker 45 for further cracking, thereby resulting in an increased overall yield of high-value chemicals for the process for producing olefins and aromatic hydrocarbons from mixed plastics.

The treated hydrocarbon liquid stream 41 can be characterized by a chloride amount that is lower than a chloride amount of the hydrocarbon liquid stream 21 and/or a chloride amount of the first fraction 26 of the hydrocarbon liquid stream. In some aspects, the treated hydrocarbon liquid stream 41 can comprise one or more chloride compounds in an amount of less than about 10 ppmw chloride, less than about 7 ppmw chloride, less than about 5 ppmw chloride, or less than about 3 ppmw chloride, based on the total weight of the treated hydrocarbon liquid stream 41.

The treated hydrocarbon liquid stream 41 can be characterized by an olefin content that is lower than an olefin content of the hydrocarbon liquid stream 21 and/or an olefin content of the first fraction 26 of the hydrocarbon liquid stream. In some aspects, the treated hydrocarbon liquid stream 41 can be characterized by an olefin content of less than about 1 wt. % olefins, based on the total weight of the treated hydrocarbon liquid stream 41.

In some aspects, and as illustrated in the configuration of olefins and aromatic hydrocarbons production systems 103 and 104 in FIGS. 3 and 4, respectively, a process for producing olefins and aromatic hydrocarbons from mixed plastics can comprise separating at least a portion of the treated hydrocarbon liquid stream 41 in the treated hydrocarbon liquid distillation unit 43 into a first fraction 44 of the treated hydrocarbon liquid stream and a second fraction 47 of the treated hydrocarbon liquid stream. The treated hydrocarbon liquid distillation unit 43 can comprise any suitable distillation column, such as a distillation column with trays or plates, a distillation column with packing material, or combinations thereof.

In some aspects, the first fraction 44 of the treated hydrocarbon liquid stream can be characterized by a boiling point of less than about 430° C., and the second fraction 47 of the hydrocarbon liquid stream can be characterized by a boiling point of equal to or greater than about 430° C. In other aspects, the first fraction 44 of the treated hydrocarbon liquid stream can be characterized by a boiling point of less than about 300° C., and the second fraction 47 of the hydrocarbon liquid stream can be characterized by a boiling point of equal to or greater than about 300° C. In yet other aspects, the first fraction 44 of the treated hydrocarbon liquid stream can be characterized by a boiling point of less than about 350° C., and the second fraction 47 of the hydrocarbon liquid stream can be characterized by a boiling point of equal to or greater than about 350° C. While the current disclosure will be discussed in detail in the context of the treated hydrocarbon liquid distillation unit 43 fractionating the treated hydrocarbon liquid stream 41 into two fractions into two fractions around a cut off boiling point of from about 300° C. to about 430° C., it should be understood that any suitable boiling point can be used as the fractionation cut off boiling point. As will be appreciated by one of skill in the art, and with the help of this disclosure, the cut off boiling point for collecting the two fractions from the treated hydrocarbon liquid distillation unit 43 can be any suitable cut off boiling point that allows both for recycling sufficient heavy compounds to the pyrolysis unit, and for having a sufficient feed stream for the liquid steam cracker 45, wherein the liquid steam cracker feed stream meets the feed requirements of the cracker. Further, it should be understood that any suitable number of fractions can be collected from the treated hydrocarbon liquid distillation unit 43, such as 2, 3, 4, 5, 6, or more fractions.

In an aspect, the cut off boiling point for fractionating the treated hydrocarbon liquid stream 41 in the treated hydrocarbon liquid distillation unit 43 into the first fraction 44 and the second fraction 47 can be from about 250° C. to about 450° C., alternatively from about 300° C. to about 430° C., or alternatively from about 325° C. to about 400° C.

In some aspects, the first fraction 44 of the treated hydrocarbon liquid stream may comprise any components of the treated hydrocarbon liquid stream 41 with a boiling point of less than about 430° C., such as paraffins, i-paraffins, olefins, naphthenes, and aromatic compounds with a boiling point of less than about 430° C. The second fraction 47 of the treated hydrocarbon liquid stream may comprise any components of the treated hydrocarbon liquid stream 41 with a boiling point of equal to or greater than about 430° C., such as paraffins, i-paraffins, olefins, naphthenes, and aromatic compounds with a boiling point of equal to or greater than about 430° C. As will be appreciated by one of skill in the art, and with the help of this disclosure, some components of the treated hydrocarbon liquid stream 41 form azeotropes, and as such, some components with a boiling point of equal to or greater than about 430° C. can be found in the first fraction 44 of the treated hydrocarbon liquid stream, although the first fraction 44 of the treated hydrocarbon liquid stream is characterized by a boiling point of less than about 430° C. Further, as will be appreciated by one of skill in the art, and with the help of this disclosure, some components of the treated hydrocarbon liquid stream 41 form azeotropes, and as such, some components with a boiling point of less than about 430° C. can be found in the second fraction 47 of the treated hydrocarbon liquid stream, although the second fraction 47 of the treated hydrocarbon liquid stream is characterized by a boiling point of equal to or greater than about 430° C.

In an aspect, the second fraction 47 of the treated hydrocarbon liquid stream can be recycled to the pyrolysis unit 10. Without wishing to be limited by theory, the second fraction 47 contains higher boiling point compounds, which have higher molecular weight and/or longer chains, and by recycling these heavier compounds to the pyrolysis unit 10, more compounds having lower molecular weight and/or shorter chains, respectively, are produced, thereby increasing an yield (e.g., volume, amount) for the feed stream introduced to the liquid steam cracker 45, consequently increasing the yield of high-value chemicals produced by the liquid steam cracker 45 (e.g., olefins, aromatic hydrocarbons).

In some aspects, a process for producing olefins and aromatic hydrocarbons from mixed plastics can comprise conveying at least a portion of the first fraction 26 of the hydrocarbon liquid stream and/or at least a portion of the treated hydrocarbon liquid stream 41 to the liquid steam cracker 45 to produce a liquid steam cracker product stream 46. As illustrated in the configuration of olefins and aromatic hydrocarbons production system 101 in FIG. 1, at least a portion of the first fraction 26 of the hydrocarbon liquid stream can be introduced to the liquid steam cracker 45. Further, as illustrated in the configuration of olefins and aromatic hydrocarbons production system 102 in FIG. 2, at least a portion of the treated hydrocarbon liquid stream 41 can be introduced to the liquid steam cracker 45.

In other aspects, and as illustrated in the configuration of olefins and aromatic hydrocarbons production systems 103 and 104 in FIGS. 3 and 4, respectively, only a portion (e.g., first fraction 44) of the treated hydrocarbon liquid stream 41 is introduced to the liquid steam cracker 45 to produce the liquid steam cracker product stream 46. In such aspects, the portion of the treated hydrocarbon liquid stream 41 that is introduced to the liquid steam cracker 45 can be recovered from stream 41 by distillation, as disclosed herein.

The first fraction 26 of the hydrocarbon liquid stream, the treated hydrocarbon liquid stream 41, and/or the first fraction 44 of the treated hydrocarbon liquid stream meet the liquid steam cracker feed requirements for chloride content, olefin content, and boiling end point.

Liquid steam cracker 45 generally has feed requirements (e.g., requires a dechlorinated feed with low olefin content) depending on operating constraints of individual steam crackers. First, the liquid steam cracker 45 requires the amount of chloride compounds in the feed to the liquid steam cracker 45 to be low. Second, the liquid steam cracker 45 requires the amount of olefins in a stream fed to the liquid steam cracker 45 to be low. The liquid steam cracker 45 cracks molecules or cleaves at elevated temperatures carbon-carbon bonds of the components in the first fraction 26 of the hydrocarbon liquid stream, the treated hydrocarbon liquid stream 41, and/or the first fraction 44 of the treated hydrocarbon liquid stream in the presence of steam to yield high-value products (e.g., high-value chemicals).

As will be appreciated by one of skill in the art, and with the help of this disclosure, the composition of the steam cracking product depends on reactor parameters (e.g., temperature, residence time, hydrocarbon to steam ratio, etc.), as well as on the composition of the feed to the cracker. Heavier hydrocarbons, such as in liquid feed streams (e.g., feed streams to liquid steam cracker 45) can produce a substantial amount of aromatic hydrocarbons (e.g., $C_6$-$C_8$ aromatic hydrocarbons), as well as olefins (e.g., light gas olefins, ethylene, propylene, butylene, butadiene, etc.). Lighter feed streams, such as gas feed streams (e.g., feed streams to gas steam cracker 35) generally produce light gas olefins, ethylene, propylene, butylene, butadiene, etc.

A liquid steam cracker product stream 46 comprising high-value chemicals can be recovered from the liquid steam cracker 45, wherein the high value chemicals comprise light gas olefins, ethylene, propylene, butylene, butadiene, aromatic compounds (e.g., $C_6$-$C_8$ aromatic hydrocarbons), and the like, or combinations thereof.

The liquid steam cracker product stream 46 can be characterized by an olefin content that is greater than an olefin content of the first fraction 26 of the hydrocarbon liquid stream, an olefin content of the treated hydrocarbon liquid stream 41, and/or an olefin content of the first fraction 44 of the treated hydrocarbon liquid stream.

In some aspects, at least a portion of the liquid steam cracker product stream 46 can be conveyed to the second separating unit 50, as will be described in more detail later herein.

In an aspect, a process for producing olefins and aromatic hydrocarbons from mixed plastics can comprise conveying at least a portion of the hydrocarbon gas stream 22 to the gas steam cracker 35 to produce a gas steam cracker product stream 36, for example as illustrated in the configuration of olefins and aromatic hydrocarbons production system 101 in FIG. 1 and system 102 in FIG. 2.

In some aspects, and as illustrated in the configuration of olefins and aromatic hydrocarbons production system 104 in FIG. 4, at least a portion of the hydrocarbon gas stream 22 and/or at least a portion of the hydroprocessing unit gas product stream 42 (e.g., a portion 42*c* of the hydroprocessing unit gas product stream) can be introduced to a scrubber 23 to produce a treated hydrocarbon gas stream 24, wherein an amount of HCl in the treated hydrocarbon gas stream 24 is less than an amount of HCl in the hydrocarbon gas stream 22 and/or the portion 42*c* of the hydroprocessing unit gas product stream; and wherein at least a portion of the HCl in the hydrocarbon gas stream 22 and/or the portion 42*c* of the hydroprocessing unit gas product stream is removed in the scrubber 23. In an aspect, a chloride amount in the treated hydrocarbon gas stream 24 is less than a chloride amount in the hydrocarbon gas stream 22 and/or a chloride amount in the portion 42*c* of the hydroprocessing unit gas product stream.

The scrubber 23 can contain a caustic solution (e.g., a solution of sodium hydroxide and/or potassium hydroxide in water) which can remove (e.g., via reaction, absorption, or combinations thereof) at least a portion of chloride (e.g., chlorine-containing gases, such as HCl) from the at least a portion of the hydrocarbon gas stream 22 and/or the portion 42*c* of the hydroprocessing unit gas product stream to yield a treated hydrocarbon gas stream 24. At least a portion of the treated hydrocarbon gas stream 24 can be further contacted with a chloride adsorber to remove any remaining chloride from the treated hydrocarbon gas stream 24. Nonlimiting examples of chloride adsorbers suitable for use in the present disclosure include attapulgite, activated carbon, dolomite, bentonite, iron oxide, goethite, hematite, magnetite, alumina, gamma alumina, silica, aluminosilicates, ion exchange resins, hydrotalcites, spinels, copper oxides, zinc oxide, sodium oxide, calcium oxide, magnesium oxide, metal loaded zeolites, molecular sieve 13X, and the like, or combinations thereof. The scrubber 23 can comprise chloride adsorbers in a fixed bed, in a fluidized bed, in an ebullated bed, or combinations thereof.

In some aspects, and as illustrated in FIGS. 3 and 4, at least a portion of the hydrocarbon gas stream 22, a portion 42*b* of the hydroprocessing unit gas product stream, and/or at least a portion of the treated hydrocarbon gas stream 24 can be introduced to the first separating unit 30 to produce a first olefin gas stream 31 and a first saturated hydrocarbons gas stream 32.

The first olefin gas stream 31 comprises at least a portion of the olefins of the at least a portion of the hydrocarbon gas stream 22, the portion 42*b* of the hydroprocessing unit gas product stream, and/or the at least a portion of the treated hydrocarbon gas stream 24. The first olefin gas stream 31 comprises ethylene, propylene, butylene, butadiene, or combinations thereof.

The first saturated hydrocarbons gas stream 32 comprises at least a portion of the saturated hydrocarbons of the at least a portion of the hydrocarbon gas stream 22, the portion 42*b* of the hydroprocessing unit gas product stream, and/or the at least a portion of the treated hydrocarbon gas stream 24. The first saturated hydrocarbons gas stream 32 comprises methane, ethane, propane, butanes, hydrogen, or combinations thereof. The first saturated hydrocarbons gas stream 32 is characterized by an olefin content of less than about 1 wt. % olefins, based on the total weight of the first saturated hydrocarbons gas stream 32. The first saturated hydrocarbons gas stream 32 is substantially free of olefins.

In some aspects, and as illustrated in FIGS. 1-4, a process for producing olefins and aromatic hydrocarbons from mixed plastics can comprise feeding at least a portion of the hydrocarbon gas stream 22, at least a portion of the hydroprocessing unit gas product stream 42 (e.g., a portion 42*a* of the hydroprocessing unit gas product stream), and/or at least a portion of the first saturated hydrocarbons gas stream 32 to the gas steam cracker 35 to produce the gas steam cracker product stream 36.

The hydrocarbon gas stream 22, the hydroprocessing unit gas product stream 42 (e.g., a portion 42*a* of the hydroprocessing unit gas product stream), and/or the first saturated hydrocarbons gas stream 32 meet the gas steam cracker feed requirements for chloride content, olefin content, and boiling end point.

Gas steam cracker 35 generally has feed requirements (e.g., requires a dechlorinated feed with low olefin content) depending on operating constraints of individual steam crackers. First, the gas steam cracker 35 requires the amount of chloride compounds in the feed to the gas steam cracker 35 to be low. Second, the gas steam cracker 35 requires the amount of olefins in a stream fed to the gas steam cracker 35 to be low. The gas steam cracker 35 cracks molecules or cleaves at elevated temperatures carbon-carbon bonds of the components in the hydrocarbon gas stream 22, the hydroprocessing unit gas product stream 42 (e.g., a portion 42*a* of the hydroprocessing unit gas product stream), and/or the first saturated hydrocarbons gas stream 32 in the presence of steam to yield high-value products (e.g., high-value chemicals). As will be appreciated by one of skill in the art, and with the help of this disclosure, the gas feed streams to the gas steam cracker 35 generally produce light gas olefins, ethylene, propylene, butylene, butadiene, etc.

A gas steam cracker product stream 36 comprising high-value chemicals can be recovered from the gas steam cracker 35, wherein the high value chemicals comprise light gas olefins, ethylene, propylene, butylene, butadiene, and the like, or combinations thereof. The gas steam cracker product stream 36 can be characterized by an olefin content that is greater than an olefin content of the hydrocarbon gas stream 22, an olefin content of the hydroprocessing unit gas product stream 42 (e.g., an olefin content of the portion 42*a* of the hydroprocessing unit gas product stream), and/or an olefin content of the first saturated hydrocarbons gas stream 32.

In some aspects, and as illustrated in FIGS. 3 and 4, at least a portion of the first olefin gas stream 31, at least a portion of the gas steam cracker product stream 36, at least a portion of the liquid steam cracker product stream 46, or combinations thereof can be introduced to the second separating unit 50 to produce a second saturated hydrocarbons gas stream 51, a second olefin gas stream 52, a $C_6$-$C_8$ aromatics stream 53, a $C_{9+}$ aromatics stream 54, and a non-aromatic heavies stream 55; wherein the second saturated hydrocarbons gas stream 51 comprises methane, ethane, propane, butanes, hydrogen, or combinations thereof; wherein the second olefin gas stream 52 comprises ethylene, propylene, butylene, butadiene, or combinations thereof; wherein the $C_6$-$C_8$ aromatics stream 53 comprises $C_6$-$C_8$ aromatic hydrocarbons, benzene, toluene, xylenes, ethylbenzene, or combinations thereof; wherein the $C_{9+}$ aromatics stream 54 comprises $C_{9+}$ aromatic hydrocarbons; and wherein the non-aromatic heavies stream 55 comprises $C_{5+}$ hydrocarbons other than $C_{6+}$ aromatic hydrocarbons. As will be appreciated by one of skill in the art, and with the help of this disclosure, the $C_{5+}$ hydrocarbons of the non-aromatic heavies stream 55 (i) exclude $C_6$ to $C_8$ aromatic hydrocarbons; (ii) exclude $C_{9+}$ aromatic hydrocarbons; (iii) include $C_{5+}$ olefins; and (iv) include $C_{5+}$ paraffins, iso-paraffins and naphthenes.

In some aspects, a portion 51*a* of the second saturated hydrocarbons gas stream can be recycled to the gas steam cracker 35. The second saturated hydrocarbons gas stream 51 is characterized by an olefin content of less than about 1 wt. % olefins, based on the total weight of the second saturated hydrocarbons gas stream 51. The second saturated hydrocarbons gas stream 51 is substantially free of olefins.

In some aspects, the non-aromatic heavies stream 55 can be characterized by a boiling point of less than about 300° C., less than 275° C., or less than 250° C. A portion 55*a* of the non-aromatic heavies stream can be recycled to the hydroprocessing unit 40 upstream of the liquid steam cracker 45. Additionally or alternatively, a portion 55*b* of the non-aromatic heavies stream can be recycled to the liquid steam cracker 45.

In some aspects, a portion 54*a* of the $C_{9+}$ aromatics stream is recycled to the hydroprocessing unit 40 upstream of the liquid steam cracker 45.

A second olefin gas stream 52 yield can be equal to or greater than about 60%, or more. A $C_6$-$C_8$ aromatics stream 53 yield can be equal to or greater than about 15%, 20%, or more. For purposes of the disclosure herein, yields are calculated with respect to the mixed plastics stream 11.

A process for producing olefins and aromatic hydrocarbons from mixed plastics can comprise (a) converting mixed plastics to a hydrocarbon product in a pyrolysis unit, wherein the hydrocarbon product comprises a gas phase and a liquid phase; (b) separating the hydrocarbon product into a hydrocarbon gas stream and a hydrocarbon liquid stream in a pyrolysis separating unit, wherein the hydrocarbon gas stream comprises at least a portion of the gas phase of the hydrocarbon product, wherein the hydrocarbon gas stream comprises olefins, saturated hydrocarbons and hydrochloric acid (HCl), and wherein the hydrocarbon liquid stream comprises at least a portion of the liquid phase of the hydrocarbon product; (c) introducing at least a portion of the hydrocarbon gas stream to a scrubber to produce a treated hydrocarbon gas stream, wherein an amount of HCl in the treated hydrocarbon gas stream is less than an amount of HCl in the hydrocarbon gas stream, and wherein at least a portion of the HCl in the hydrocarbon gas stream is removed in the scrubber; (d) introducing at least a portion of the treated hydrocarbon gas stream to a first separating unit to produce a first saturated hydrocarbons gas stream and a first olefin gas stream, wherein the first olefin gas stream comprises at least a portion of the olefins of the treated hydrocarbon gas stream, wherein the first saturated hydrocarbons gas stream comprises at least a portion of the saturated hydrocarbons of the treated hydrocarbon gas stream, and wherein the first saturated hydrocarbons gas stream is characterized by an olefin content of less than about 1 wt. % olefins, based on the total weight of the first saturated hydrocarbons gas stream; (e) feeding at least a portion of the first saturated hydrocarbons gas stream to a gas steam cracker to produce a gas steam cracker product stream, wherein an amount of olefins in the gas steam cracker product stream is greater than an amount of olefins in the first saturated hydrocarbon gas stream; (f) separating at least a portion of the hydrocarbon liquid stream into a first fraction of the hydrocarbon liquid stream and a second fraction of the hydrocarbon liquid stream, wherein the first fraction of the hydrocarbon liquid stream is characterized by a boiling point of less than about 430° C., or alternatively less than about 300° C., and wherein the second fraction of the hydrocarbon liquid stream is characterized by a boiling point of equal to or greater than about 430° C., or alternatively equal to or greater than about 300° C.; (g) conveying at least a portion of the first fraction of the hydrocarbon liquid stream and hydrogen to a hydroprocessing unit to produce a treated hydrocarbon liquid stream and a hydroprocessing unit gas product stream, wherein the treated hydrocarbon liquid stream is characterized by a chloride amount of less than about 10 ppmw chloride, based on the total weight of the treated hydrocarbon liquid stream, and wherein the treated hydrocarbon liquid stream is characterized by an olefin content of less than about 1 wt. % olefins, based on the total weight of the treated hydrocarbon liquid stream; (h) separating at least a portion of the treated hydrocarbon liquid stream into a first fraction of the treated hydrocarbon liquid stream and a second fraction of the treated hydrocarbon liquid stream, wherein the first fraction of the treated hydrocarbon liquid stream is characterized by a boiling point that is lower than a boiling point of the second fraction of the treated hydrocarbon liquid stream; (i) feeding at least a portion of the first fraction of the treated hydrocarbon liquid stream to a liquid steam cracker to produce a liquid steam cracker product stream, wherein an amount of olefins in the liquid steam cracker product stream is greater than an amount of olefins in the first fraction of the treated hydrocarbon liquid stream; (j) feeding at least a portion of the hydroprocessing unit gas product stream to the scrubber, the first separating unit, and/or the gas steam cracker; (k) introducing at least a portion of the gas steam cracker product stream, at least a portion of the liquid steam cracker product stream, at least a portion of the first olefin gas stream, or combinations thereof to a second separating unit to produce a second olefin gas stream, a second saturated hydrocarbons gas stream, a $C_6$-$C_8$ aromatics stream, a $C_{9+}$ aromatics stream, and a non-aromatic heavies stream; wherein the second olefin gas stream comprises ethylene, propylene, butylene, butadiene, or combinations thereof; wherein the second saturated hydrocarbons gas stream comprises methane, ethane, propane, butanes, hydrogen, or combinations thereof; wherein the $C_6$-$C_8$ aromatics stream comprises $C_6$-$C_8$ aromatic hydrocarbons, benzene, toluene, xylenes, ethylbenzene, or combinations thereof; wherein the $C_{9+}$ aromatics stream comprises $C_{9+}$ aromatic hydrocarbons; and wherein the non-aromatic heavies stream comprises $C_{5+}$ hydrocarbons other than $C_{6+}$ aromatic hydrocarbons; (l) recycling at least a portion of the second saturated hydrocarbons gas stream to the gas steam cracker; (m) recycling at least a portion of the non-aromatic heavies stream and/or at least a portion of the $C_{9+}$ aromatics stream to the hydroprocessing unit; and (n) recycling at least a portion of the second fraction of the hydrocarbon liquid stream and/or at least a portion of the second fraction of the treated hydrocarbon liquid stream to the pyrolysis unit. As will be appreciated by one of skill in the art, and with the help of this disclosure, when the first fraction of the hydrocarbon liquid stream is characterized by a boiling point of less than about 430° C., the second fraction of the hydrocarbon liquid stream is characterized by a boiling point of equal to or greater than about 430° C. Further, as will be appreciated by one of skill in the art, and with the help of this disclosure, when the first fraction of the hydrocarbon liquid stream is characterized by a boiling point of less than about 300° C., the second fraction of the hydrocarbon liquid stream is characterized by a boiling point of equal to or greater than about 300° C.

Processes for producing olefins and aromatic hydrocarbons from mixed plastics as disclosed herein can advantageously display improvements in one or more process characteristics when compared to otherwise similar processes that do not employ a liquid steam cracker for cracking the liquids obtained from pyrolysis and a gas steam cracker for cracking the gases obtained from pyrolysis. Processes for producing olefins and aromatic hydrocarbons from mixed plastics as disclosed herein can advantageously provide for an overall increased yield of light gas olefins, as well as $C_6$-$C_8$ aromatics.

Processes for producing olefins and aromatic hydrocarbons from mixed plastics as disclosed herein can advantageously recycle saturated streams to steam cracking, as well as heavy aromatics streams to hydrocracking, thereby increasing the overall yield of high-value chemicals such as olefins and $C_6$-$C_8$ aromatics. Additional advantages of the processes for producing olefins and aromatic hydrocarbons from mixed plastics as disclosed herein can be apparent to one of skill in the art viewing this disclosure.

EXAMPLES

The subject matter having been generally described, the following examples are given as particular embodiments of the disclosure and to demonstrate the practice and advantages thereof. It is understood that the examples are given by way of illustration and are not intended to limit the specification of the claims to follow in any manner.

Example 1

A mixed plastic waste was cracked in modular units at low severity conditions; or catalytically cracked in a circulating fluidized bed at high severity; or catalytically cracked in a circulating fluidized bed at low severity to produce a pyrolysis oil. The results from these cracking experiments are shown below. The cup mix temperature was varied between 400-600° C., specifically 450-550° C. Depending on the severity of the operation, the gases and the liquid products were separated. The composition of the cracked liquid product is shown below in the tables. The saturated hydrocarbons present in the gas were sent to gas crackers which were an ethane cracker or propane cracker. The gas cracker was selected depending on the desired end product. The cracked liquid from the pyrolysis unit was sent to hydrotreating to saturate all the liquid olefins, as this is a requirement for the liquid/naphtha cracker. Hydrotreating was performed at 300-450° C. and at a pressure of 20-100 barg using commercially available hydrotreating catalyst to produce a hydrotreated oil. The typical composition of this hydrotreated oil was 35-45% paraffins, 35-45% iso-paraffins, 15-20% naphthenes and 5-10% aromatics, with a liquid boiling below 400° C. The table below shows an example of the composition of the hydrotreated oil (e.g., treated hydrocarbon liquid stream, such as stream 41). The hydrotreated oil was then subjected to steam cracking wherein the light gas olefins were maximized and the gas saturates formed were routed to a gas cracker. In this example, 16.3 wt. % saturates produced by pyrolysis were sent to the gas cracker to form more light gas olefins, such as ethylene and propylene.

The hydrotreated oil, normally a pygas, was naphtha range material with high aromatic content. This liquid can be subjected to aromatic extraction after mild hydrogenation and a non-aromatic stream can be sent back to the naphtha/steam cracker for further cracking.

The results for a saturated pyrolysis oil feed to the steam cracker having a composition of paraffins, olefins, naphthenes, and aromatics (P/O/N/A) are shown below

| | Catalyst recipe | | |
|---|---|---|---|
| | 80% spent. FCC catalyst + 20% ZSM-5 zeolite catalyst Low severity | 80% spent FCC catalyst + 20% ZSM-5 zeolite catalyst High severity | 65% spent FCC catalyst + 35% ZSM-5 zeolite catalyst High severity |
| Avg cup mix temp, ° C. | 452 | 521 | 553.9 |
| Product yields, wt. % | | | |
| H2—C4 gas | 47.90 | 55.1 | 61.6 |
| Liquids | 43.30 | 35.9 | 31.3 |
| Coke | 8.80 | 6.2 | 5.6 |
| Light gas olefins | 28.55 | 36.61 | 41.65 |
| Gas Saturates | 17.32 | 15.93 | 17.62 |
| Gasoline | 37.00 | 30.37 | 24.54 |
| Diesel | 5.31 | 4.43 | 5.36 |
| Heavies | 0.99 | 1.06 | 1.41 |

| Product composition of mixed plastic pyrolysis after cracking | Thermally cracked from modular technology unit | Catalytically cracked from circulating fluidized bed |
|---|---|---|
| P | 45 | 9.5 |
| O | 34 | 4.2 |
| N | 11 | 3.6 |
| A | 9.4 | 82.7 |

| Product composition of mixed plastic pyrolyzed liquid after hydro treating | Thermally cracked from modular technology unit | Catalytically cracked from circulating fluidized bed |
|---|---|---|
| P | 62 | 11.6 |
| O | 0 | 0.0 |
| N | 28.6 | 5.7 |
| A | 9.4 | 82.7 |

Depending on the composition for the pyrolysis liquid, whether it is from low severity catalytic cracking from continuous circulating fluidized bed or from thermal cracking from any modular technology, the aromatic extraction unit can be positioned before the steam cracker or after the steam cracker. If the aromatic content of the pyrolysis liquid is greater 40%, having the aromatic extraction before steam cracker could minimize the coke formation and also maximize recovery of high value chemicals like benzene, toluene, xylene and ethyl benzene before sending it to steam cracker.

The products obtained from the steam cracker are displayed below at steam/oil (S/O) ratio of 2 wt. %, a reaction residence time of 0.1 sec, and a temperature of 850° C. For purposes of the disclosure herein, the S/O ratio refers to the ratio expressed in mass percentage of the steam added to the steam cracker per total hydrocarbon feed of the steam cracker.

| Component | Steam cracker product wt. % |
|---|---|
| Methane | 14.2 |
| Hydrogen | |
| Ethylene | 32.8 |
| Propylene | 17.8 |
| Butylenes | |
| Saturates | 16.3 |
| Gasoline | 14.5 |
| Disel | 4.4 |

Example 2

This example is related to low and high severity pyrolysis of mixed waste plastic having 82% olefinic feed (e.g., high-density polyethylene (HDPE), low-density polyethylene (LDPE), linear low-density polyethylene (LLDPE), and polypropylene (PP)); 11% polystyrene (PS); and the remaining 7% polyethylene terephthalate (PET). This experiment was conducted in a continuous catalytic cracking circulating fluidized bed. In all cases, the light gas olefin make in the first step was >28% and saturates, which saturates can be sent directly to gas crackers to further increase the light gas olefins. The gasoline and diesel range material can be hydrotreated to saturate the liquid olefins and can be further sent to naphtha cracker. The overall make of light gas olefins combining the first stage pyrolysis followed by gas cracking of saturated gas molecules and naphtha cracker for liquids can account for >60 wt. % of fed plastics.

The unconverted saturates can be recycled back to the cracker for further cracking and formation of light gas olefins. The pygas obtained from the naphtha cracker would be rich in aromatics which would be sent to aromatic extraction for separations of benzene, toluene, xylene (BTX) and ethylbenzene (EB) (BTX+EB).

Overall, by combining a pyrolyzer with a gas cracker and a liquid cracker, the high value chemicals like light gas olefins would be >60% and BTX+EB>15-20%.

Yields of liquid saturates in the gasoline and diesel range based on PIONA of pyrolysis oil would be sent to naphtha cracker for converting to high value chemicals. The $C_6$-$C_8$ range aromatics which are BTX+EB would be separated after hydrogenation. The higher aromatics which are normally di- and tri-aromatics would also be saturated or converted by ring opening and then a total feed consisting of gasoline saturates, diesel and heavies range saturates would be fed to the steam cracker to boost the overall yield of light gas olefins and BTX+EB range aromatics.

Example 3

This example is related to low and high severity pyrolysis of mixed waste plastic having 82% olefinic feed (e.g., high-density polyethylene (HDPE), low-density polyethylene (LDPE), linear low-density polyethylene (LLDPE), and polypropylene (PP)); 11% polystyrene (PS); and the remaining 7% polyethylene terephthalate (PET). This experiment was conducted in a continuous catalytic cracking circulating fluidized bed.

| | Catalyst recipe | | |
|---|---|---|---|
| | 80% spent FCC catalyst + 20% ZSM-5 zeolite catalyst Low severity | 80% spent FCC catalyst + 20% ZSM-5 zeolite catalyst High severity | 65% spent FCC catalyst + 35% ZSM-5 zeolite catalyst High severity |
| Avg cup mix temp. ° C. | 452 | 521 | 553.9 |
| Gas saturates feed to gas cracker | 17.32 | 15.93 | 17.62 |
| Gasoline saturates yield | 37.40 | 30.37 | 24.54 |
| C6-C8 aromatics concentration in liquid product cut boiling below 240° C. | 49.3 | 52.27 | 54.9 |
| Diesel and heavies yield | 6.30 | 5.49 | 6.77 |
| Diesel and Heavies saturated yield after hydrotreating (assuming complete saturation) | 6.69 | 5.83 | 7.19 |

Overall, through the above examples, the processes involved in the process configuration of the integrated flowsheets as depicted in FIGS. 1-4 have been demonstrated to produce light gas olefins and mono-ring aromatics in the $C_6$-$C_8$ range.

The present disclosure is further illustrated by the following embodiments, which are not to be construed in any way as imposing limitations upon the scope thereof. On the contrary, it is to be clearly understood that resort can be had to various other aspects, embodiments, modifications, and equivalents thereof which, after reading the description herein, can be suggest to one of ordinary skill in the art without departing from the spirit of the present invention or the scope of the appended claims.

Additional Disclosure

The following are enumerated aspects which are provided as non-limiting examples.

A first aspect, which is a process for producing olefins and aromatic hydrocarbons from mixed plastics comprising (a) converting mixed plastics to a hydrocarbon product in a pyrolysis unit, wherein the hydrocarbon product comprises a gas phase and a liquid phase; (b) separating at least a portion of the hydrocarbon product into a hydrocarbon gas stream and a hydrocarbon liquid stream, wherein the hydrocarbon gas stream comprises at least a portion of the gas phase of the hydrocarbon product, and wherein the hydrocarbon liquid stream comprises at least a portion of the liquid phase of the hydrocarbon product; (c) feeding at least a portion of the hydrocarbon gas stream to a gas steam cracker to produce a gas steam cracker product stream, wherein the gas steam cracker product stream comprises olefins, and wherein an amount of olefins in the gas steam cracker product stream is greater than an amount of olefins in the hydrocarbon gas stream; (d) separating at least a portion of the hydrocarbon liquid stream into a first fraction of the hydrocarbon liquid stream and a second fraction of the hydrocarbon liquid stream, wherein the first fraction of the hydrocarbon liquid stream is characterized by a boiling point of less than about 300° C., and wherein the second fraction of the hydrocarbon liquid stream is characterized by a boiling point of equal to or greater than about 300° C.; (e) feeding at least a portion of the first fraction of the hydrocarbon liquid stream to a liquid steam cracker to produce a liquid steam cracker product stream, wherein the liquid steam cracker product stream comprises olefins and aromatic hydrocarbons, and wherein an amount of olefins in the liquid steam cracker product stream is greater than an amount of olefins in the first fraction of the hydrocarbon liquid stream; and (f) recycling at least a portion of the second fraction of the hydrocarbon liquid stream to the pyrolysis unit.

A second aspect, which is the process of the first aspect, wherein the olefins of the gas steam cracker product stream comprise light gas olefins, ethylene, propylene, butylene, butadiene, or combinations thereof.

A third aspect, which is the process of any one of the first and the second aspects, wherein the hydrocarbon gas stream further comprises hydrochloric acid (HCl), carbon monoxide (CO), carbon dioxide ($CO_2$), hydrogen ($H_2$), light gas olefins, and saturated hydrocarbons, and wherein the step (c) of feeding at least a portion of the hydrocarbon gas stream to a gas steam cracker further comprises (i) introducing at least a portion of the hydrocarbon gas stream to a scrubber to produce a treated hydrocarbon gas stream, wherein an amount of HCl in the treated hydrocarbon gas stream is less than an amount of HCl in the hydrocarbon gas stream, and wherein at least a portion of the HCl in the hydrocarbon gas stream is removed in the scrubber; (ii) introducing at least a portion of the treated hydrocarbon gas stream to a first separating unit to produce a first saturated hydrocarbons gas stream and a first olefin gas stream, wherein the first olefin gas stream comprises at least a portion of the olefins of the treated hydrocarbon gas stream, wherein the first saturated hydrocarbons gas stream comprises at least a portion of the saturated hydrocarbons of the treated hydrocarbon gas stream, and wherein the first saturated hydrocarbons gas stream is characterized by an olefin content of less than about 1 wt. % olefins, based on the total weight of the first saturated hydrocarbons gas stream; and (iii) feeding at least a portion of the first saturated hydrocarbons gas stream to the gas steam cracker.

A fourth aspect, which is the process of any one of the first through the third aspects, wherein the step (d) of feeding at least a portion of the first fraction of the hydrocarbon liquid stream to a liquid steam cracker further comprises (i) conveying at least a portion of the first fraction of the hydrocarbon liquid stream and hydrogen to a hydroprocessing unit to produce a treated hydrocarbon liquid stream and a hydroprocessing unit gas product stream, wherein the treated hydrocarbon liquid stream is characterized by a boiling point that is lower than a boiling point of the first fraction of the hydrocarbon liquid stream; wherein the treated hydrocarbon liquid stream is characterized by a chloride amount that is lower than a chloride amount of the first fraction of the hydrocarbon liquid stream; and wherein the treated hydrocarbon liquid stream is characterized by an olefin content that is lower than an olefin content of the first fraction of the hydrocarbon liquid stream; and (ii) feeding at least a portion of the treated hydrocarbon liquid stream to the liquid steam cracker.

A fifth aspect, which is the process of the fourth aspect, wherein the treated hydrocarbon liquid stream is characterized by a boiling point of less than about 300° C.

A sixth aspect, which is the process of any one of the first through the fifth aspects, wherein the treated hydrocarbon liquid stream comprises one or more chloride compounds in an amount of less than about 10 ppmw chloride, based on the total weight of the treated hydrocarbon liquid stream.

A seventh aspect, which is the process of any one of the first through the sixth aspects, wherein the treated hydrocarbon liquid stream is characterized by an olefin content of less than about 1 wt. % olefins, based on the total weight of the treated hydrocarbon liquid stream.

An eighth aspect, which is the process of any one of the first through the seventh aspects, wherein the first fraction of the hydrocarbon liquid stream comprises aromatic compounds, and wherein a portion of the aromatic compounds undergo a ring opening reaction in the hydroprocessing unit to produce non-aromatic compounds.

A ninth aspect, which is the process of any one of the first through the eighth aspects, wherein the step (i) of conveying at least a portion of the first fraction of the hydrocarbon liquid stream and hydrogen to a hydroprocessing unit to produce a treated hydrocarbon liquid stream and a hydroprocessing unit gas product stream further comprises (1) recovering a hydroprocessing unit product stream from the hydroprocessing unit, wherein the hydroprocessing unit product stream comprises a gas phase and a liquid phase; and (2) separating the hydroprocessing unit product stream into the treated hydrocarbon liquid stream and the hydroprocessing unit gas product stream, wherein the treated hydrocarbon liquid stream comprises at least a portion of the liquid phase of the hydroprocessing unit product stream; and wherein the hydroprocessing unit gas product stream comprises at least a portion of the gas phase of the hydroprocessing unit product stream.

A tenth aspect, which is the process of any one of the first through the ninth aspects, wherein at least a portion of the hydroprocessing unit gas product stream is fed to the gas steam cracker.

An eleventh aspect, which is the process of the third aspect, wherein at least a portion of the gas steam cracker product stream, at least a portion of the liquid steam cracker product stream, at least a portion of the first olefin gas stream, or combinations thereof are introduced to a second separating unit to produce a second olefin gas stream, a second saturated hydrocarbons gas stream, a $C_6$-$C_8$ aromatics stream, a $C_{9+}$ aromatics stream, and a non-aromatic heavies stream; wherein the second olefin gas stream comprises ethylene, propylene, butylene, butadiene, or combinations thereof; wherein the second saturated hydrocarbons gas stream comprises methane, ethane, propane, butanes, hydrogen, or combinations thereof; wherein the $C_6$-$C_8$ aromatics stream comprises $C_6$-$C_8$ aromatic hydrocarbons, benzene, toluene, xylenes, ethylbenzene, or combinations thereof; wherein the $C_{9+}$ aromatics stream comprises $C_{9+}$ aromatic hydrocarbons; and wherein the non-aromatic heavies stream comprises $C_{5+}$ hydrocarbons other than $C_{6+}$ aromatic hydrocarbons.

A twelfth aspect, which is the process of the eleventh aspect, wherein a second olefin gas stream yield is equal to or greater than about 60%.

A thirteenth aspect, which is the process of any one of the first through the twelfth aspects, wherein a $C_6$-$C_8$ aromatics stream yield is equal to or greater than about 15%.

A fourteenth aspect, which is the process of any one of the first through the thirteenth aspects, wherein at least a portion of the second saturated hydrocarbons gas stream is recycled to the gas steam cracker.

A fifteenth aspect, which is the process of any one of the first through the fourteenth aspects, wherein the non-aromatic heavies stream is characterized by a boiling point of less than about 300° C., and wherein at least a portion of the non-aromatic heavies stream is recycled to the liquid steam cracker and/or a hydroprocessing unit upstream of the liquid steam cracker.

A sixteenth aspect, which is the process of any one of the first through the fifteenth aspects, wherein the non-aromatic heavies stream is characterized by a boiling point of less than about 300° C., and wherein at least a portion of the non-aromatic heavies stream and at least a portion of the $C_{9+}$ aromatics stream are recycled to a hydroprocessing unit upstream of the liquid steam cracker.

A seventeenth aspect, which is the process of the sixteenth aspect further comprising (i) recovering a treated hydrocarbon liquid stream from the hydroprocessing unit; (ii) separating at least a portion of the treated hydrocarbon liquid stream into a first fraction of the treated hydrocarbon liquid stream and a second fraction of the treated hydrocarbon liquid stream, wherein the first fraction of the treated hydrocarbon liquid stream is characterized by a boiling point of less than about 300° C., and wherein the second fraction of the treated hydrocarbon liquid stream is characterized by a boiling point of equal to or greater than about 300° C.; (iii) feeding at least a portion of the first fraction of the treated hydrocarbon liquid stream to the liquid steam cracker to produce the liquid steam cracker product stream; and (iv) recycling at least a portion of the second fraction of the treated hydrocarbon liquid stream to the pyrolysis unit.

An eighteenth aspect, which is the process of any one of the first through the seventeenth aspects, wherein the mixed plastics comprise equal to or greater than about 400 ppmw polyvinylchloride and/or polyvinylidene chloride, based on the total weight of the mixed plastics.

A nineteenth aspect, which is the process of any one of the first through the eighteenth aspects, wherein the mixed plastics are virgin mixed plastics or waste mixed plastics.

A twentieth aspect, which is a process for producing olefins and aromatic hydrocarbons from mixed plastics comprising (a) converting mixed plastics to a hydrocarbon product in a pyrolysis unit, wherein the hydrocarbon product comprises a gas phase and a liquid phase; (b) separating the hydrocarbon product into a hydrocarbon gas stream and a hydrocarbon liquid stream, wherein the hydrocarbon gas stream comprises at least a portion of the gas phase of the hydrocarbon product, and wherein the hydrocarbon liquid stream comprises at least a portion of the liquid phase of the hydrocarbon product; (c) feeding at least a portion of the hydrocarbon gas stream to a gas steam cracker to produce a gas steam cracker product stream, wherein the gas steam cracker product stream comprises olefins, and wherein an amount of olefins in the gas steam cracker product stream is greater than an amount of olefins in the hydrocarbon gas stream; (d) separating at least a portion of the hydrocarbon liquid stream into a first fraction of the hydrocarbon liquid stream and a second fraction of the hydrocarbon liquid stream, wherein the first fraction of the hydrocarbon liquid stream is characterized by a boiling point of less than about 300° C., and wherein the second fraction of the hydrocarbon liquid stream is characterized by a boiling point of equal to or greater than about 300° C.; (e) conveying at least a portion of the first fraction of the hydrocarbon liquid stream and hydrogen to a hydroprocessing unit to produce a treated hydrocarbon liquid stream and a hydroprocessing unit gas product stream, wherein the treated hydrocarbon liquid stream is characterized by a boiling point of less than about 300° C., wherein the treated hydrocarbon liquid stream is characterized by a chloride amount of less than about 10 ppmw chloride, based on the total weight of the treated hydrocarbon liquid stream, and wherein the treated hydrocarbon liquid stream is characterized by an olefin content of less than about 1 wt. % olefins, based on the total weight of the treated hydrocarbon liquid stream; (f) feeding at least a portion of the treated hydrocarbon liquid stream to a liquid steam cracker to produce a liquid steam cracker product stream, wherein the liquid steam cracker product stream comprises olefins and aromatic hydrocarbons, and wherein an amount of olefins in the liquid steam cracker product stream is greater than an amount of olefins in the hydrocarbon liquid stream; and (g) recycling at least a portion of the second fraction of the hydrocarbon liquid stream to the pyrolysis unit.

A twenty-first aspect, which is the process of the twentieth aspect, wherein at least a portion of the hydroprocessing unit gas product stream is fed to the gas steam cracker.

A twenty-second aspect, which is a process for producing olefins and aromatic hydrocarbons from mixed plastics comprising (a) converting mixed plastics to a hydrocarbon product in a pyrolysis unit, wherein the hydrocarbon product comprises a gas phase and a liquid phase; (b) separating the hydrocarbon product into a hydrocarbon gas stream and a hydrocarbon liquid stream, wherein the hydrocarbon gas stream comprises at least a portion of the gas phase of the hydrocarbon product, wherein the hydrocarbon gas stream comprises olefins and saturated hydrocarbons, and wherein the hydrocarbon liquid stream comprises at least a portion of the liquid phase of the hydrocarbon product; (c) introducing at least a portion of the hydrocarbon gas stream to a first separating unit to produce a first saturated hydrocarbons gas stream and a first olefin gas stream, wherein the first olefin gas stream comprises at least a portion of the olefins of the hydrocarbon gas stream, wherein the first saturated hydrocarbons gas stream comprises at least a portion of the saturated hydrocarbons of the hydrocarbon gas stream, and wherein the first saturated hydrocarbons gas stream is characterized by an olefin content of less than about 1 wt. % olefins, based on the total weight of the first saturated hydrocarbons gas stream; (d) feeding at least a portion of the first saturated hydrocarbons gas stream to a gas steam cracker to produce a gas steam cracker product stream, wherein an amount of olefins in the gas steam cracker product stream is greater than an amount of olefins in the first saturated hydrocarbon gas stream; (e) conveying at least a portion of the hydrocarbon liquid stream and hydrogen to a hydroprocessing unit to produce a treated hydrocarbon liquid stream and a hydroprocessing unit gas product stream, wherein the treated hydrocarbon liquid stream is characterized by a chloride amount of less than about 10 ppmw chloride, based on the total weight of the treated hydrocarbon liquid stream, and wherein the treated hydrocarbon liquid stream is characterized by an olefin content of less than about 1 wt. % olefins, based on the total weight of the treated hydrocarbon liquid stream; (f) separating at least a portion of the treated hydrocarbon liquid stream into a first fraction of the treated hydrocarbon liquid stream and a second fraction of the treated hydrocarbon liquid stream, wherein the first fraction of the treated hydrocarbon liquid stream is characterized by a boiling point of less than about 430° C., and wherein the second fraction of the treated hydrocarbon liquid stream is characterized by a boiling point of equal to or greater than about 430° C.; (g) feeding at least a portion of the first fraction of the treated hydrocarbon liquid stream to a liquid steam cracker to produce a liquid steam cracker product stream, wherein an amount of olefins in the liquid steam cracker product stream is greater than an amount of olefins in the first fraction of the treated hydrocarbon liquid stream; (h) feeding at least a portion of the hydroprocessing unit gas product stream to the first separating unit and/or the gas steam cracker; (i) introducing at least a portion of the gas steam cracker product stream, at least a portion of the liquid steam cracker product stream, at least a portion of the first olefin gas stream, or combinations thereof to a second separating unit to produce a second olefin gas stream, a second saturated hydrocarbons gas stream, a $C_6$-$C_8$ aromatics stream, a $C_{9+}$ aromatics stream, and a non-aromatic heavies stream; wherein the second olefin gas stream comprises ethylene, propylene, butylene, butadiene, or combinations thereof; wherein the second saturated hydrocarbons gas stream comprises methane, ethane, propane, butanes, hydrogen, or combinations thereof; wherein the $C_6$-$C_8$ aromatics stream comprises $C_6$-$C_8$ aromatic hydrocarbons, benzene, toluene, xylenes, ethylbenzene, or combinations thereof; wherein the $C_{9+}$ aromatics stream comprises $C_{9+}$ aromatic hydrocarbons; and wherein the non-aromatic heavies stream comprises $C_{5+}$ hydrocarbons other than $C_{6+}$ aromatic hydrocarbons; (j) recycling at least a portion of the second saturated hydrocarbons gas stream to the gas steam cracker; (k) recycling at least a portion of the non-aromatic heavies stream and at least a portion of the $C_{9+}$ aromatics stream to the hydroprocessing unit; and (l) recycling at least a portion of the second fraction of the treated hydrocarbon liquid stream to the pyrolysis unit.

A twenty-third aspect, which is the process of the twenty-second aspect, wherein a second olefin gas stream yield is equal to or greater than about 60%; and wherein a $C_6$-$C_8$ aromatics stream yield is equal to or greater than about 15%.

A twenty-fourth aspect, which is a process for producing olefins and aromatic hydrocarbons from mixed plastics comprising (a) converting mixed plastics to a hydrocarbon product in a pyrolysis unit, wherein the hydrocarbon product comprises a gas phase and a liquid phase; (b) separating the hydrocarbon product into a hydrocarbon gas stream and a hydrocarbon liquid stream in a pyrolysis separating unit, wherein the hydrocarbon gas stream comprises at least a portion of the gas phase of the hydrocarbon product, wherein the hydrocarbon gas stream comprises olefins, saturated hydrocarbons and hydrochloric acid (HCl), and wherein the hydrocarbon liquid stream comprises at least a portion of the liquid phase of the hydrocarbon product; (c) introducing at least a portion of the hydrocarbon gas stream to a scrubber to produce a treated hydrocarbon gas stream, wherein an amount of HCl in the treated hydrocarbon gas stream is less than an amount of HCl in the hydrocarbon gas stream, and wherein at least a portion of the HCl in the hydrocarbon gas stream is removed in the scrubber; (d) introducing at least a portion of the treated hydrocarbon gas stream to a first separating unit to produce a first saturated hydrocarbons gas stream and a first olefin gas stream, wherein the first olefin gas stream comprises at least a portion of the olefins of the treated hydrocarbon gas stream, wherein the first saturated hydrocarbons gas stream comprises at least a portion of the saturated hydrocarbons of the treated hydrocarbon gas stream, and wherein the first saturated hydrocarbons gas stream is characterized by an olefin content of less than about 1 wt. % olefins, based on the total weight of the first saturated hydrocarbons gas stream; (e) feeding at least a portion of the first saturated hydrocarbons gas stream to a gas steam cracker to produce a gas steam cracker product stream, wherein an amount of olefins in the gas steam cracker product stream is greater than an amount of olefins in the first saturated hydrocarbon gas stream; (f) separating at least a portion of the hydrocarbon liquid stream into a first fraction of the hydrocarbon liquid stream and a second fraction of the hydrocarbon liquid stream, wherein the first fraction of the hydrocarbon liquid stream is characterized by a boiling point that is lower than a boiling of the second fraction of the hydrocarbon liquid stream, and wherein the boiling point of the first fraction of the hydrocarbon liquid stream is less than from about 300° C. to about 430° C.; (g) conveying at least a portion of the first fraction of the hydrocarbon liquid stream and hydrogen to a hydroprocessing unit to produce a treated hydrocarbon liquid stream and a hydroprocessing unit gas product stream, wherein the treated hydrocarbon liquid stream is characterized by a chloride amount of less than about 10 ppmw chloride, based on the total weight of the treated hydrocarbon liquid stream, and wherein the treated hydrocarbon liquid stream is characterized by an olefin content of less than about 1 wt. % olefins, based on the total weight of the treated hydrocarbon liquid stream; (h) separating at least a portion of the treated hydrocarbon liquid stream into a first fraction of the treated hydrocarbon liquid stream and a second fraction of the treated hydrocarbon liquid stream, wherein the first fraction of the treated hydrocarbon liquid stream is characterized by a boiling point that is lower than a boiling point of the second fraction of the treated hydrocarbon liquid stream, and wherein the boiling point of the first fraction of the treated hydrocarbon liquid stream is less than about 350° C.; (i) feeding at least a portion of the first fraction of the treated hydrocarbon liquid stream to a liquid steam cracker to produce a liquid steam cracker product stream, wherein an amount of olefins in the liquid steam cracker product stream is greater than an amount of olefins in the first fraction of the treated hydrocarbon liquid stream; (j) feeding at least a portion of the hydroprocessing unit gas product stream to the scrubber, the first separating unit, the gas steam cracker, or combinations thereof; (k) introducing at least a portion of the gas steam cracker product stream, at least a portion of the liquid steam cracker product stream, at least a portion of the first olefin gas stream, or combinations thereof to a second separating unit to produce a second olefin gas stream, a second saturated hydrocarbons gas stream, a $C_6$-$C_8$ aromatics stream, a $C_{9+}$ aromatics stream, and a non-aromatic heavies stream; wherein the second olefin gas stream comprises ethylene, propylene, butylene, butadiene, or combinations thereof; wherein the second saturated hydrocarbons gas stream comprises methane, ethane, propane, butanes, hydrogen, or combinations thereof; wherein the $C_6$-$C_8$ aromatics stream comprises $C_6$-$C_8$ aromatic hydrocarbons, benzene, toluene, xylenes, ethylbenzene, or combinations thereof; wherein the $C_{9+}$ aromatics stream comprises $C_{9+}$ aromatic hydrocarbons; and wherein the non-aromatic heavies stream comprises $C_{5+}$ hydrocarbons other than $C_{6+}$ aromatic hydrocarbons; (l) recycling at least a portion of the second saturated hydrocarbons gas stream to the gas steam cracker; (m) recycling at least a portion of the non-aromatic heavies stream and/or at least a portion of the $C_{9+}$ aromatics stream to the hydroprocessing unit; (n) recycling at least a portion of the second fraction of the hydrocarbon liquid stream and/or at least a portion of the second fraction of the treated hydrocarbon liquid stream to the pyrolysis unit; and (o) optionally recycling at least a portion of the non-aromatic heavies stream to the liquid steam cracker.

While aspects of the disclosure have been shown and described, modifications thereof can be made without departing from the spirit and teachings of the invention. The aspects and examples described herein are exemplary only, and are not intended to be limiting. Many variations and modifications of the invention disclosed herein are possible and are within the scope of the invention.

Accordingly, the scope of protection is not limited by the description set out above but is only limited by the claims which follow, that scope including all equivalents of the subject matter of the claims. Each and every claim is incorporated into the specification as an aspect of the present invention. Thus, the claims are a further description and are an addition to the detailed description of the present invention. The disclosures of all patents, patent applications, and publications cited herein are hereby incorporated by reference.

What is claimed is:

1. A process for producing olefins and aromatic hydrocarbons from mixed plastics, the process comprising the steps of:

(a) converting mixed plastics to a hydrocarbon product in a pyrolysis unit, wherein the hydrocarbon product comprises a gas phase and a liquid phase;

(b) separating at least a portion of the hydrocarbon product into a hydrocarbon gas stream and a hydrocarbon liquid stream, wherein the hydrocarbon gas stream comprises at least a portion of the gas phase of the hydrocarbon product, and wherein the hydrocarbon liquid stream comprises at least a portion of the liquid phase of the hydrocarbon product;

(c) feeding at least a portion of the hydrocarbon gas stream to a gas steam cracker to produce a gas steam cracker product stream, wherein the gas steam cracker product stream comprises olefins, and wherein an amount of olefins in the gas steam cracker product stream is greater than an amount of olefins in the hydrocarbon gas stream;

(d) separating at least a portion of the hydrocarbon liquid stream into a first fraction of the hydrocarbon liquid stream and a second fraction of the hydrocarbon liquid stream, wherein the first fraction of the hydrocarbon liquid stream is characterized by a boiling point of less than about 300° C., and wherein the second fraction of the hydrocarbon liquid stream is characterized by a boiling point of equal to or greater than about 300° C.;

(e) feeding at least a portion of the first fraction of the hydrocarbon liquid stream to a liquid steam cracker to produce a liquid steam cracker product stream, wherein the liquid steam cracker product stream comprises olefins and aromatic hydrocarbons, and wherein an amount of olefins in the liquid steam cracker product stream is greater than an amount of olefins in the first fraction of the hydrocarbon liquid stream; and (f) recycling at least a portion of the second fraction of the hydrocarbon liquid stream to the pyrolysis unit.

2. The process of claim 1, wherein the olefins of the gas steam cracker product stream comprise light gas olefins, ethylene, propylene, butylene, butadiene, or combinations thereof.

3. The process of claim 1, wherein the hydrocarbon gas stream further comprises hydrochloric acid (HCl), carbon monoxide (CO), carbon dioxide ($CO_2$), hydrogen ($H_2$), light gas olefins, and saturated hydrocarbons, and wherein the step (c) of feeding at least a portion of the hydrocarbon gas stream to a gas steam cracker further comprises (i) introducing at least a portion of the hydrocarbon gas stream to a scrubber to produce a treated hydrocarbon gas stream, wherein an amount of HCl in the treated hydrocarbon gas stream is less than an amount of HCl in the hydrocarbon gas stream, and wherein at least a portion of the HCl in the hydrocarbon gas stream is removed in the scrubber; (ii) introducing at least a portion of the treated hydrocarbon gas stream to a first separating unit to produce a first saturated hydrocarbons gas stream and a first olefin gas stream, wherein the first olefin gas stream comprises at least a portion of the olefins of the treated hydrocarbon gas stream, wherein the first saturated hydrocarbons gas stream comprises at least a portion of the saturated hydrocarbons of the treated hydrocarbon gas stream, and wherein the first saturated hydrocarbons gas stream is characterized by an olefin content of less than about 1 wt. % olefins, based on the total weight of the first saturated hydrocarbons gas stream; and (iii) feeding at least a portion of the first saturated hydrocarbons gas stream to the gas steam cracker.

4. The process of claim 1, wherein the step (d) of feeding at least a portion of the first fraction of the hydrocarbon liquid stream to a liquid steam cracker further comprises (i) conveying at least a portion of the first fraction of the hydrocarbon liquid stream and hydrogen to a hydroprocessing unit to produce a treated hydrocarbon liquid stream and a hydroprocessing unit gas product stream, wherein the treated hydrocarbon liquid stream is characterized by a boiling point that is lower than a boiling point of the first fraction of the hydrocarbon liquid stream; wherein the treated hydrocarbon liquid stream is characterized by a chloride amount that is lower than a chloride amount of the first fraction of the hydrocarbon liquid stream; and wherein the treated hydrocarbon liquid stream is characterized by an olefin content that is lower than an olefin content of the first fraction of the hydrocarbon liquid stream; and (ii) feeding at least a portion of the treated hydrocarbon liquid stream to the liquid steam cracker.

5. The process of claim 4, wherein the treated hydrocarbon liquid stream is characterized by a boiling point of less than about 300° C.

6. The process of claim 4, wherein the treated hydrocarbon liquid stream comprises one or more chloride compounds in an amount of less than about 10 ppmw chloride, based on the total weight of the treated hydrocarbon liquid stream; and wherein the treated hydrocarbon liquid stream is characterized by an olefin content of less than about 1 wt. % olefins, based on the total weight of the treated hydrocarbon liquid stream.

7. The process of claim 4, wherein the first fraction of the hydrocarbon liquid stream comprises aromatic compounds, and wherein a portion of the aromatic compounds undergo a ring opening reaction in the hydroprocessing unit to produce non-aromatic compounds.

8. The process of claim 4, wherein the step (i) of conveying at least a portion of the first fraction of the hydrocarbon liquid stream and hydrogen to a hydroprocessing unit to produce a treated hydrocarbon liquid stream and a hydroprocessing unit gas product stream further comprises (1) recovering a hydroprocessing unit product stream from the hydroprocessing unit, wherein the hydroprocessing unit product stream comprises a gas phase and a liquid phase; and (2) separating the hydroprocessing unit product stream into the treated hydrocarbon liquid stream and the hydroprocessing unit gas product stream, wherein the treated hydrocarbon liquid stream comprises at least a portion of the liquid phase of the hydroprocessing unit product stream; and wherein the hydroprocessing unit gas product stream comprises at least a portion of the gas phase of the hydroprocessing unit product stream.

9. The process of claim 4, wherein at least a portion of the hydroprocessing unit gas product stream is fed to the gas steam cracker.

10. The process of claim 3, wherein at least a portion of the gas steam cracker product stream, at least a portion of the liquid steam cracker product stream, at least a portion of the first olefin gas stream, or combinations thereof are introduced to a second separating unit to produce a second olefin gas stream, a second saturated hydrocarbons gas stream, a $C_6$-$C_8$ aromatics stream, a $C_{9+}$ aromatics stream, and a non-aromatic heavies stream; wherein the second olefin gas stream comprises ethylene, propylene, butylene, butadiene, or combinations thereof; wherein the second saturated hydrocarbons gas stream comprises methane, ethane, propane, butanes, hydrogen, or combinations thereof; wherein the $C_6$-$C_8$ aromatics stream comprises $C_6$-$C_8$ aromatic hydrocarbons, benzene, toluene, xylenes, ethylbenzene, or combinations thereof; wherein the $C_{9+}$ aromatics stream comprises $C_{9+}$ aromatic hydrocarbons; and wherein the non-aromatic heavies stream comprises $C_{5+}$ hydrocarbons other than $C_{6+}$ aromatic hydrocarbons.

11. The process of claim 10, wherein a second olefin gas stream yield is equal to or greater than about 60%; and wherein a $C_6$-$C_8$ aromatics stream yield is equal to or greater than about 15%.

12. The process of claim 10, wherein at least a portion of the second saturated hydrocarbons gas stream is recycled to the gas steam cracker.

13. The process of claim 10, wherein the non-aromatic heavies stream is characterized by a boiling point of less than about 300° C., and wherein at least a portion of the non-aromatic heavies stream is recycled to the liquid steam cracker and/or a hydroprocessing unit upstream of the liquid steam cracker.

14. The process of claim 10, wherein the non-aromatic heavies stream is characterized by a boiling point of less than about 300° C., and wherein at least a portion of the non-aromatic heavies stream and at least a portion of the $C_{9+}$ aromatics stream are recycled to a hydroprocessing unit upstream of the liquid steam cracker.

15. The process of claim 14 further comprising (i) recovering a treated hydrocarbon liquid stream from the hydroprocessing unit; (ii) separating at least a portion of the treated hydrocarbon liquid stream into a first fraction of the treated hydrocarbon liquid stream and a second fraction of the treated hydrocarbon liquid stream, wherein the first fraction of the treated hydrocarbon liquid stream is characterized by a boiling point of less than about 300° C., and wherein the second fraction of the treated hydrocarbon liquid stream is characterized by a boiling point of equal to or greater than about 300° C.; (iii) feeding at least a portion of the first fraction of the treated hydrocarbon liquid stream to the liquid steam cracker to produce the liquid steam cracker product stream; and (iv) recycling at least a portion of the second fraction of the treated hydrocarbon liquid stream to the pyrolysis unit.

16. The process of claim 1, wherein the mixed plastics comprise equal to or greater than about 400 ppmw polyvinylchloride and/or polyvinylidene chloride, based on the total weight of the mixed plastics; and wherein the mixed plastics are virgin mixed plastics or waste mixed plastics.

17. A process for producing olefins and aromatic hydrocarbons from mixed plastics, the process comprising the steps of:

(a) converting mixed plastics to a hydrocarbon product in a pyrolysis unit, wherein the hydrocarbon product comprises a gas phase and a liquid phase;

(b) separating the hydrocarbon product into a hydrocarbon gas stream and a hydrocarbon liquid stream, wherein the hydrocarbon gas stream comprises at least a portion of the gas phase of the hydrocarbon product, and wherein the hydrocarbon liquid stream comprises at least a portion of the liquid phase of the hydrocarbon product;

(c) feeding at least a portion of the hydrocarbon gas stream to a gas steam cracker to produce a gas steam cracker product stream, wherein the gas steam cracker product stream comprises olefins, and wherein an amount of olefins in the gas steam cracker product stream is greater than an amount of olefins in the hydrocarbon gas stream;

(d) separating at least a portion of the hydrocarbon liquid stream into a first fraction of the hydrocarbon liquid stream and a second fraction of the hydrocarbon liquid stream, wherein the first fraction of the hydrocarbon liquid stream is characterized by a boiling point of less than about 300° C., and wherein the second fraction of the hydrocarbon liquid stream is characterized by a boiling point of equal to or greater than about 300° C.;

(e) conveying at least a portion of the first fraction of the hydrocarbon liquid stream and hydrogen to a hydroprocessing unit to produce a treated hydrocarbon liquid stream and a hydroprocessing unit gas product stream, wherein the treated hydrocarbon liquid stream is characterized by a boiling point of less than about 300° C., wherein the treated hydrocarbon liquid stream is characterized by a chloride amount of less than about 10 ppmw chloride, based on the total weight of the treated hydrocarbon liquid stream, and wherein the treated hydrocarbon liquid stream is characterized by an olefin content of less than about 1 wt. % olefins, based on the total weight of the treated hydrocarbon liquid stream;

(f) feeding at least a portion of the treated hydrocarbon liquid stream to a liquid steam cracker to produce a liquid steam cracker product stream, wherein the liquid steam cracker product stream comprises olefins and aromatic hydrocarbons, and wherein an amount of olefins in the liquid steam cracker product stream is greater than an amount of olefins in the hydrocarbon liquid stream; and (g) recycling at least a portion of the second fraction of the hydrocarbon liquid stream to the pyrolysis unit.

18. The process of claim 17, wherein at least a portion of the hydroprocessing unit gas product stream is fed to the gas steam cracker.

19. A process for producing olefins and aromatic hydrocarbons from mixed plastics, the process comprising the steps of:

(a) converting mixed plastics to a hydrocarbon product in a pyrolysis unit, wherein the hydrocarbon product comprises a gas phase and a liquid phase;

(b) separating the hydrocarbon product into a hydrocarbon gas stream and a hydrocarbon liquid stream, wherein the hydrocarbon gas stream comprises at least a portion of the gas phase of the hydrocarbon product, wherein the hydrocarbon gas stream comprises olefins and saturated hydrocarbons, and wherein the hydrocarbon liquid stream comprises at least a portion of the liquid phase of the hydrocarbon product;

(c) introducing at least a portion of the hydrocarbon gas stream to a first separating unit to produce a first saturated hydrocarbons gas stream and a first olefin gas stream, wherein the first olefin gas stream comprises at least a portion of the olefins of the hydrocarbon gas stream, wherein the first saturated hydrocarbons gas stream comprises at least a portion of the saturated hydrocarbons of the hydrocarbon gas stream, and wherein the first saturated hydrocarbons gas stream is characterized by an olefin content of less than about 1 wt. % olefins, based on the total weight of the first saturated hydrocarbons gas stream;

(d) feeding at least a portion of the first saturated hydrocarbons gas stream to a gas steam cracker to produce a gas steam cracker product stream, wherein an amount of olefins in the gas steam cracker product stream is greater than an amount of olefins in the first saturated hydrocarbon gas stream;

(e) conveying at least a portion of the hydrocarbon liquid stream and hydrogen to a hydroprocessing unit to produce a treated hydrocarbon liquid stream and a hydroprocessing unit gas product stream, wherein the treated hydrocarbon liquid stream is characterized by a chloride amount of less than about 10 ppmw chloride, based on the total weight of the treated hydrocarbon liquid stream, and wherein the treated hydrocarbon liquid stream is characterized by an olefin content of less than about 1 wt. % olefins, based on the total weight of the treated hydrocarbon liquid stream;

(f) separating at least a portion of the treated hydrocarbon liquid stream into a first fraction of the treated hydrocarbon liquid stream and a second fraction of the treated hydrocarbon liquid stream, wherein the first fraction of the treated hydrocarbon liquid stream is characterized by a boiling point of less than about 430° C., and wherein the second fraction of the treated hydrocarbon liquid stream is characterized by a boiling point of equal to or greater than about 430° C.;

(g) feeding at least a portion of the first fraction of the treated hydrocarbon liquid stream to a liquid steam cracker to produce a liquid steam cracker product stream, wherein an amount of olefins in the liquid steam cracker product stream is greater than an amount of olefins in the first fraction of the treated hydrocarbon liquid stream;

(h) feeding at least a portion of the hydroprocessing unit gas product stream to the first separating unit and/or the gas steam cracker;

(i) introducing at least a portion of the gas steam cracker product stream, at least a portion of the liquid steam cracker product stream, at least a portion of the first olefin gas stream, or combinations thereof to a second separating unit to produce a second olefin gas stream, a second saturated hydrocarbons gas stream, a $C_6$-$C_8$ aromatics stream, a $C_{9+}$ aromatics stream, and a non-aromatic heavies stream; wherein the second olefin gas stream comprises ethylene, propylene, butylene, butadiene, or combinations thereof; wherein the second saturated hydrocarbons gas stream comprises methane, ethane, propane, butanes, hydrogen, or combinations thereof; wherein the $C_6$-$C_8$ aromatics stream comprises $C_6$-$C_8$ aromatic hydrocarbons, benzene, toluene, xylenes, ethylbenzene, or combinations thereof; wherein the $C_{9+}$ aromatics stream comprises $C_{9+}$ aromatic hydrocarbons; and wherein the non-aromatic heavies stream comprises $C_{5+}$ hydrocarbons other than $C_{6+}$ aromatic hydrocarbons;

(j) recycling at least a portion of the second saturated hydrocarbons gas stream to the gas steam cracker;

(k) recycling at least a portion of the non-aromatic heavies stream and at least a portion of the $C_{9+}$ aromatics stream to the hydroprocessing unit; and (l) recycling at least a portion of the second fraction of the treated hydrocarbon liquid stream to the pyrolysis unit.

20. The process of claim 19, wherein a second olefin gas stream yield is equal to or greater than about 60%; and wherein a $C_6$-$C_8$ aromatics stream yield is equal to or greater than about 15%.

* * * * *